US007722182B2

(12) United States Patent
Sasa

(10) Patent No.: US 7,722,182 B2
(45) Date of Patent: May 25, 2010

(54) INKJET RECORDING DEVICE AND DRIVING UNIT PROVIDED THEREIN

(75) Inventor: Masahiko Sasa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 578 days.

(21) Appl. No.: 11/612,452

(22) Filed: Dec. 18, 2006

(65) Prior Publication Data

US 2007/0146463 A1 Jun. 28, 2007

(30) Foreign Application Priority Data

Dec. 27, 2005 (JP) ..... 2005-375952
Dec. 28, 2005 (JP) ..... 2005-379602

(51) Int. Cl.
*B41J 25/308* (2006.01)
*B41J 2/01* (2006.01)
*B41J 13/00* (2006.01)

(52) U.S. Cl. ..... 347/104; 347/8; 347/101; 347/107; 400/578; 400/642

(58) Field of Classification Search ..... 347/5, 347/8, 16, 101, 104, 107; 400/642
See application file for complete search history.

(56) References Cited

U.S. PATENT DOCUMENTS 5,757,407 A 5/1998 Rezanka
5,874,979 A 2/1999 Ohyama
5,940,092 A * 8/1999 Kashimura et al. ..... 347/8
6,179,419 B1 1/2001 Rasmussen et al.
6,239,817 B1 5/2001 Meyer
6,471,351 B1 10/2002 Ishikawa et al.
6,659,603 B2 12/2003 Kida et al.
7,086,729 B2 8/2006 Yoshikaie
7,093,931 B2 8/2006 Ishii et al.
2002/0154203 A1* 10/2002 Tanaka ..... 347/104
2002/0191064 A1 12/2002 Ishikawa et al.
2005/0122384 A1* 6/2005 Kodama et al. ..... 347/104

FOREIGN PATENT DOCUMENTS

JP H09-234916 A 9/1997
JP 2000-118058 A 4/2000
JP 2001-080145 A 3/2001
JP 2002-307769 A 10/2002
JP 2003-285487 A 10/2003
JP 2005-007691 A 1/2005
JP 2006-326990 A 12/2006

OTHER PUBLICATIONS

European Patent Office, Communication pursuant to Article 94(3) European Patent Convention dated Sep. 5, 2008, for related European Patent Application No. 06256426.5.

* cited by examiner

*Primary Examiner*—Matthew Luu
*Assistant Examiner*—Kendrick X Liu
(74) *Attorney, Agent, or Firm*—Baker Botts L.L.P.

(57) ABSTRACT

An inkjet-recording device includes a recording head, a platen, a conveying member, and a movable supporting member. The recording head ejects ink droplets onto a recording medium. The platen is disposed in confrontation with the recording head to support the recording medium while keeping a predetermined distance from the recording head. The conveying member conveys the recording medium in a conveying direction. The movable supporting member is linked to the conveying member to slide in the conveying direction while supporting the recording medium.

21 Claims, 25 Drawing Sheets

INKJET RECORDING DEVICE AND DRIVING UNIT PROVIDED THEREIN

CROSS REFERENCE TO RELATED APPLICATIONS

This application claims priorities from Japanese Patent Applications No. 2005-375952 filed on Dec. 27, 2005 and No. 2005-379602 filed on Dec. 28, 2005. The entire content of each of these priority applications is incorporated herein by reference.

TECHNICAL FIELD

The disclosure relates to an inkjet-recording device and components employed in this device, and particularly to the structure of a component functioning to drive a movable support piece provided on a platen.

BACKGROUND

An inkjet-recording device includes a recording head with a plurality of juxtaposed nozzles. A recording paper is conveyed below the recording head while the recording head forms an image on the paper. The recording head records an image on the recording paper by moving in a main scanning direction (orthogonal to the paper-conveying direction), while ejecting ink droplets from the nozzles at a prescribed timing. In recent years, inkjet-recording devices have been provided with a photo printing function. This type of image recording is called "borderless recording" because the image is recorded without leaving margins on the edges of the recording paper.

In borderless recording, the recording head is moved beyond the edges of the paper and ink is ejected to a point outside the region occupied by the recording paper. For example, in Japanese unexamined patent application publication No. 2000-118058, when borderless recording is performed on the leading and trailing edges of the recording paper, the recording paper is positioned relative to the recording head so that a portion of the nozzles in the recording head is positioned off the edge of the recording paper. Consequently, the recording head ejects ink droplets through these nozzles onto a platen provided below the recording paper. The platen is provided with a groove formed in the top portion thereof and extending in the main scanning direction, and an ink absorbing material disposed inside this groove for absorbing the ink droplets. This configuration makes it possible to record an image over the entire recording paper, without leaving a border along the edges of the recording paper, while preventing ink ejected onto the platen from staining the underside of the recording paper.

There has also been a demand in recent years for inkjet-recording devices capable of recording images at a faster rate. Conventional attempts to increase the image recording speed have involved increasing the size of the recording head in order to increase the number of nozzles arranged in the paper-conveying direction. However, in order to perform high-quality borderless recording, it has been necessary to increase the width (dimension in the paper-conveying direction) of the groove provided in the platen as the size of the recording head is increased.

However, since the recording paper is positioned above this groove when performing borderless recording, an increased groove width may cause the recording paper to deform, bending downward into the groove. Such bending of the recording paper changes the distances between nozzles in the recording head and the surface of the recording paper, potentially leading to recording problems.

To resolve this problem, Japanese unexamined patent application publications Nos. 2001-80145 and 2002-307769 proposed providing paper support members in the groove formed in the platen. These paper support members rotate along with the recording paper as the recording paper is conveyed. The paper support members support the recording paper advancing over the groove, while moving in the width direction of the groove. Hence, the paper support members can support the recording paper when the recording paper is conveyed over the groove formed in the platen.

SUMMARY

However, since the conventional paper support members rotate about a prescribed rotational shaft (see Japanese unexamined patent application publication No. 2001-80145), the distal edges of the paper support members (the portion contacting the recording paper) first approach and then separate from the recording head side. Therefore, the recording paper is not always supported parallel to the recording head. While this problem can be resolved by sufficiently increasing the rotational radius of the paper support members, doing so would also increase the size of the inkjet-recording device. Some devices have paper support members with surfaces for supporting the recording paper in the shape of an arc centered on the rotational shaft. However, this structure fixes the points at which the recording paper is supported so that the edges of the conveyed recording paper are not always supported. In other words, when the surfaces supporting the recording paper are formed in arc shapes, the recording paper is only supported at the support points and can bend in regions outside the support points (areas in front of or behind the support points), potentially leading to the same recording problems described above.

In view of the foregoing, it is an object of the invention to provide an inkjet-recording device capable of performing high-speed borderless recording while ensuring that the edges of the conveyed recording paper are always supported on the platen.

In order to attain the above and other objects, the invention provides an inkjet-recording device including a recording head, a platen, a conveying member, and a movable supporting member. The recording head ejects ink droplets onto a recording medium. The platen is disposed in confrontation with the recording head to support the recording medium while keeping a predetermined distance from the recording head. The conveying member conveys the recording medium in a conveying direction. The movable supporting member is linked to the conveying member to slide in the conveying direction while supporting the recording medium.

Another aspect of the invention provides a driving unit for sliding a movable supporting member from a first part to a second part in a conveying direction of a recording medium while supporting the recording medium on a platen. The movable supporting member has an engaging portion. The driving unit includes a rotating plate having a rotational shaft, rotatable about the rotational shaft, and formed with a guide groove engagable with the engaging portion to guide the engaging portion in the conveying direction as the rotating plate rotates.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION

Next, the invention will be described in detail based on preferred embodiments, while referring to the accompanying drawings. These embodiments are merely examples of the invention, and it should be apparent to those skilled in the art that many modifications and variations may be made therein without departing from the spirit of the invention.

First Embodiment

Figure 1:
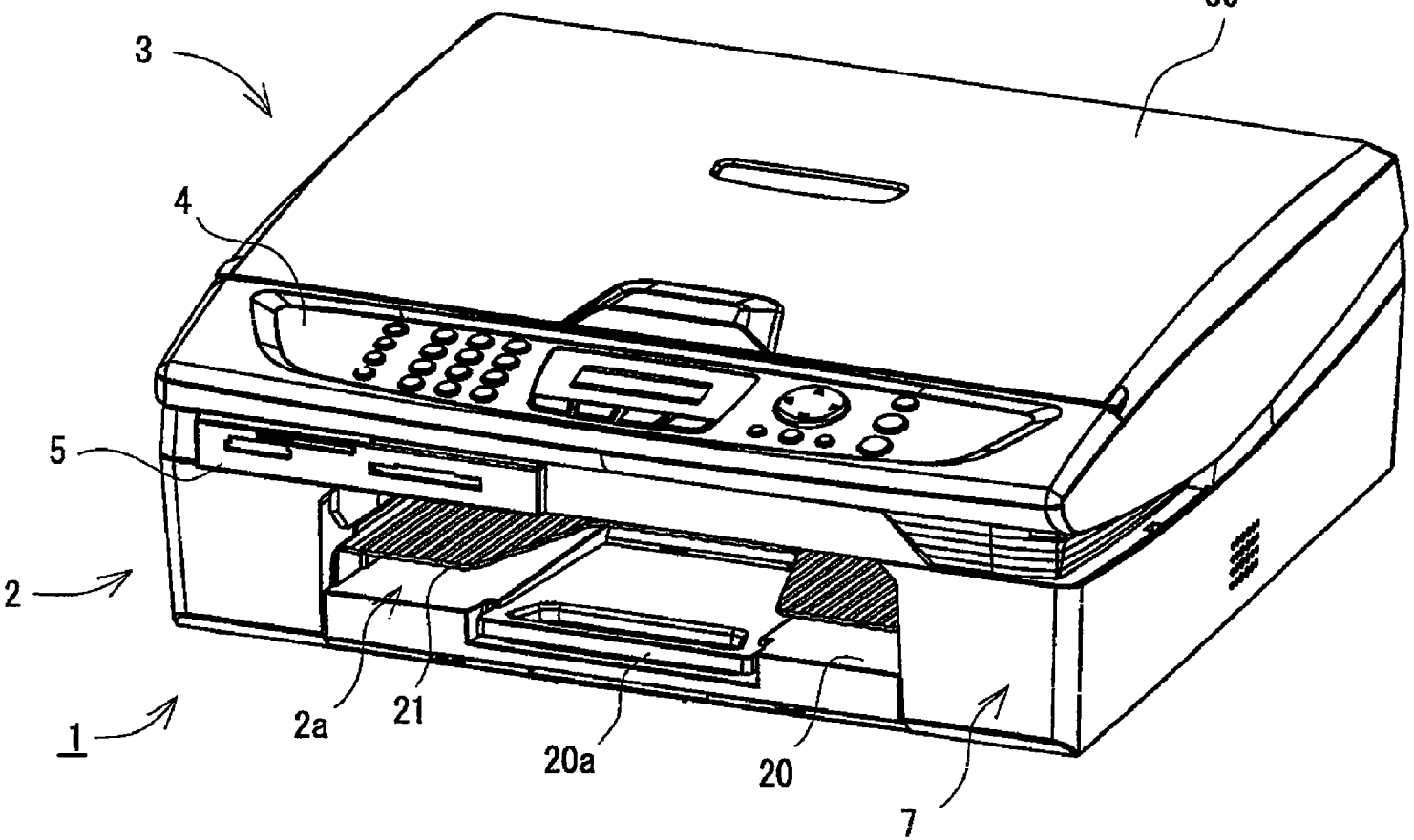
FIG. 1 is an external perspective view of a multifunction device according to a first embodiment of the invention.
Figure 2:
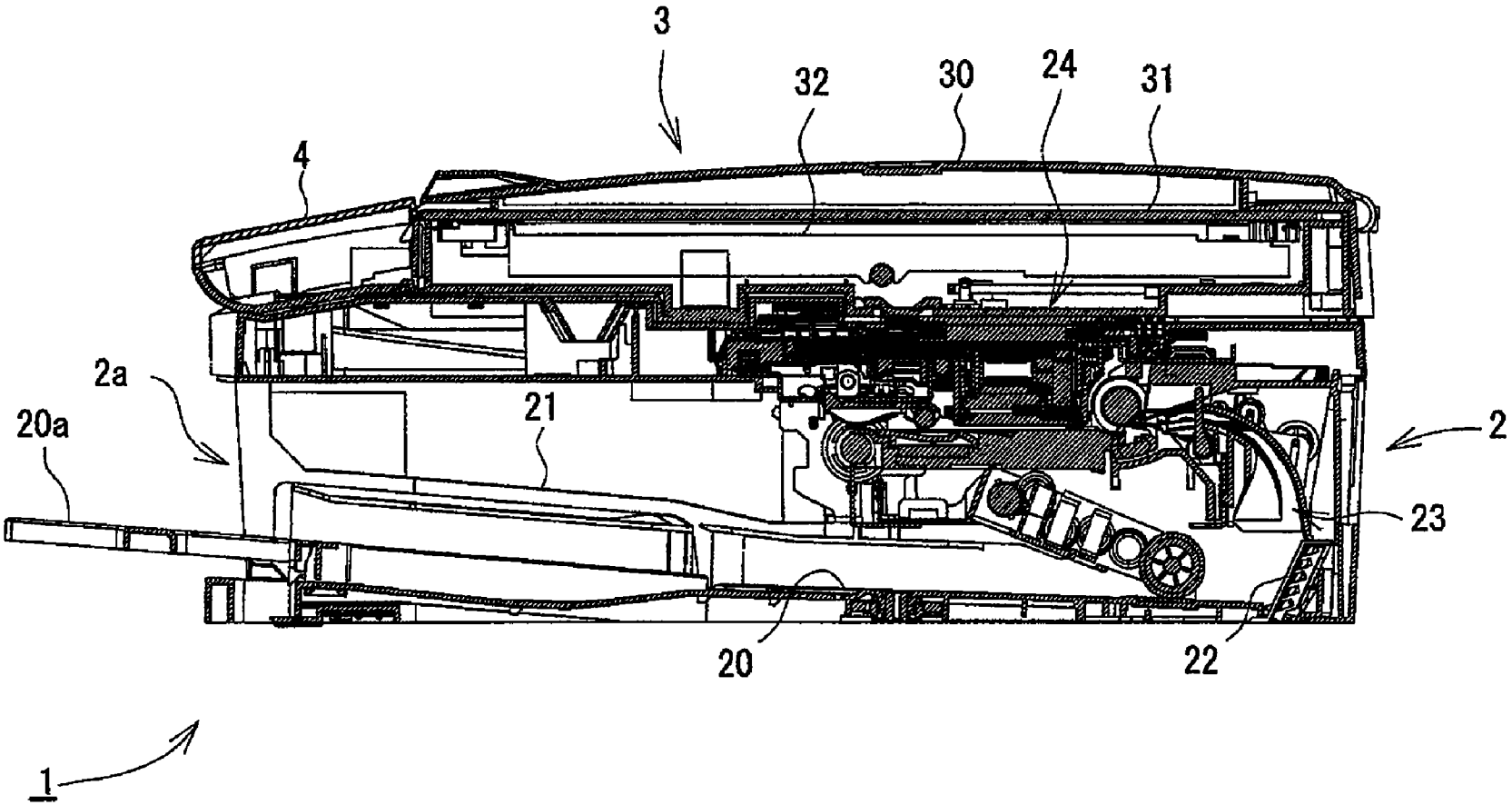
FIG. 2 is a vertical cross-sectional view of the multifunction device according to the first embodiment.

FIG. 1 is a perspective view showing an external appearance of a multifunction device 1 that incorporates a movable support piece drive member (rotating plate 125 described later) according to the first embodiment of the invention. FIG. 2 is a vertical cross-sectional view showing the internal structure of the multifunction device 1.

The multifunction device 1 possesses a printer function, scanner function, copier function, and facsimile function, specifically, is integrally provided with a printer section 2 in the lower section and configured of an inkjet-recording device; and a scanner section 3 in the upper section. Alternatively, it is possible to omit all functions from the multifunction device 1 except the printer function. For example, the multifunction device 1 may be configured as a stand-alone printer by omitting the scanner section 3. The features of the preferred embodiment are as follows. As will be described later with reference to FIG. 9, the printer section 2 includes a platen 42 for supporting a recording paper, a movable support piece 88 provided on the platen 42, and an interlock mechanism 105 for sliding the movable support piece 88 in response to conveyance of the recording paper. Specifically, the interlock mechanism 105 is provided with the rotating plate 125 (see FIG. 12) for sliding the movable support piece 88 in synchronization with the conveyance of the recording paper.

The printer section 2 of the multifunction device 1 is primarily connected to a computer or other external information device for recording text and images on a recording paper based on print data including text or image data transmitted from the computer or the like. The multifunction device 1 may also be connected to a digital camera or the like and may record image data inputted from the digital camera on recording paper. Also, the multifunction device 1 may be loaded with a memory card or other storage medium and may be capable of recording image data and the like stored on the storage medium on recording paper.

As shown in FIG. 1, the multifunction device 1 is substantially shaped as a thin rectangular parallelepiped with greater width and depth dimensions than the height dimension. The printer section 2 provided in the lower section of the multifunction device 1 has an opening 2*a* formed in the front surface thereof. A feeding tray 20 and a discharge tray 21 are stacked vertically in two levels in the opening 2*a*. The feeding tray 20 is capable of accommodating recording paper of various sizes as large as the A4 size and including the B5 size and postcard size. The feeding tray 20 includes a slidable tray 20*a* that can be pulled outward when needed, as shown in FIG. 2, to expand the surface area of the tray. With this construction, the feeding tray 20 can accommodate legal sized recording paper, for example. Recording paper accommodated in the feeding tray 20 is supplied into the printer section 2 to undergo a desired image recording process, and is subsequently discharged onto the discharge tray 21.

The scanner section 3 disposed in the upper section of the multifunction device 1 is a flatbed scanner. As shown in FIGS. 1 and 2, the multifunction device 1 includes an original cover 30 on the top thereof that is capable of opening and closing, and a platen glass 31 disposed below the original cover 30 and an image sensor 32 disposed below the platen glass 31. The platen glass 31 functions to support an original document when an image on the document is being scanned. The image sensor 32 is capable of reciprocating in the width direction of the multifunction device 1 (vertical direction in FIG. 2), wherein the main scanning direction of the image sensor 32 is the depth direction of the multifunction device 1 (left-to-right direction in FIG. 2).

A control panel 4 is provided on the top front surface of the multifunction device 1 for operating the printer section 2 and the scanner section 3. The control panel 4 is configured of various operating buttons and a liquid crystal display. The multifunction device 1 operates based on operating instructions inputted through the control panel 4 and, when connected to an external computer, operates based on instructions that the computer transmits through a printer driver or a scanner driver. A slot section 5 in which various small memory cards or other storage media can be inserted is provided in the upper left section of the multifunction device 1 on the front surface thereof (see FIG. 1). A user can input operating instructions via the control panel 4 to read image data stored on a memory card that is inserted into the slot section 5 and to display the image data on the liquid crystal display of the control panel 4, and can further input instructions to record a desired image on recording paper using the printer section 2.

Next, the internal structure of the multifunction device 1, and particularly the structure of the printer section 2, will be described.

As shown in FIG. 2, a sloped separating plate 22 is disposed near the rear side of the feeding tray 20 provided in the lower section of the multifunction device 1 for separating recording paper stacked in the feeding tray 20 and guiding the separated paper upward. A paper-conveying path 23 leads upward from the sloped separating plate 22, curves toward the front of the multifunction device 1, and extends in the rear-to-front direction therefrom. The paper-conveying path 23 passes an image-recording unit 24 and leads to the discharge tray 21. Hence, the paper-conveying path 23 guides recording paper conveyed from the feeding tray 20 along U-shaped path that curves upward and back in the opposite direction to the image-recording unit 24. After the image-recording unit 24 has recorded an image on the paper, the paper continues along the paper-conveying path 23 and is discharged onto the discharge tray 21.

Figure 3:
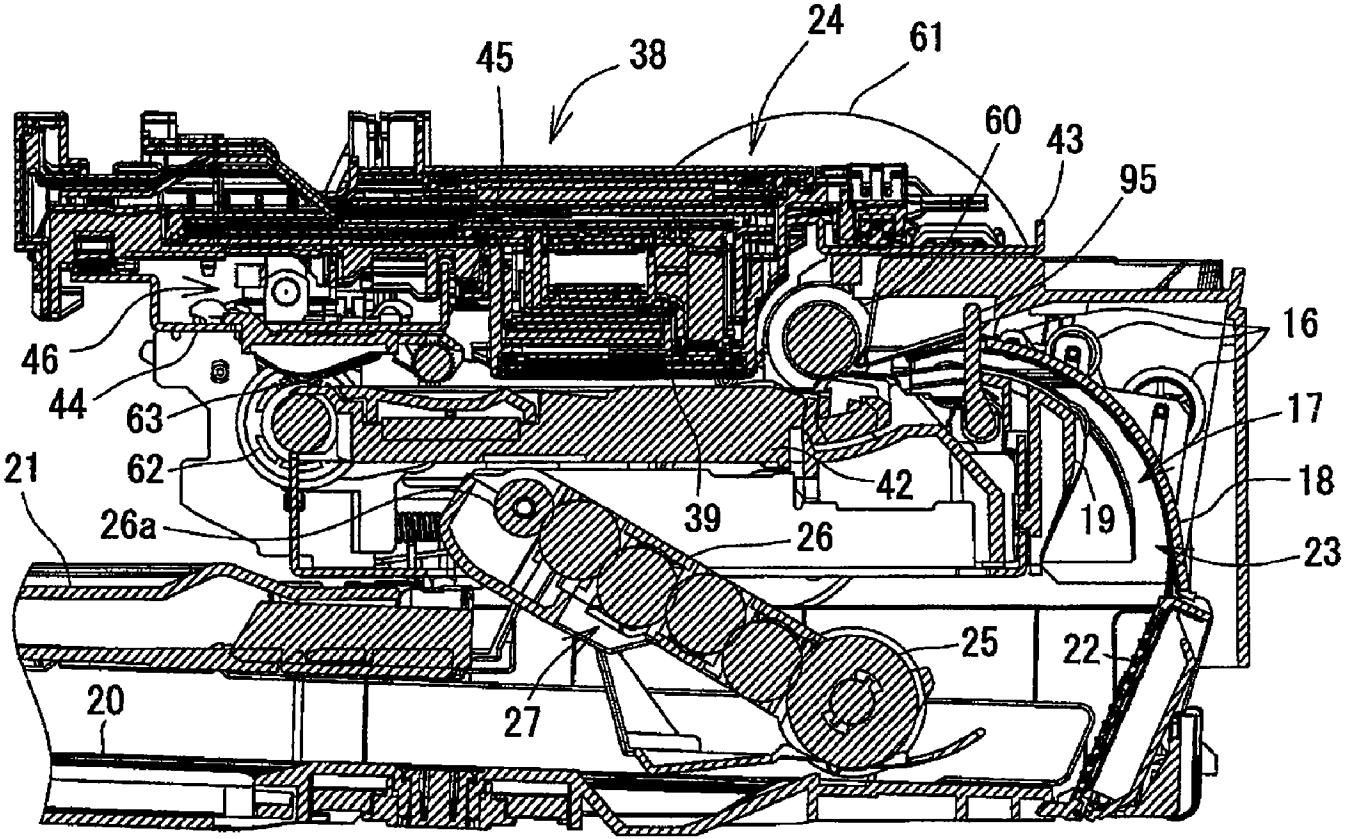
FIG. 3 is an enlarged cross-sectional view of the multifunction device according to the first embodiment.

FIG. 3 is an enlarged cross-sectional view showing the principal structure of the printer section 2.

As shown in FIG. 3, a feeding roller 25 is disposed above the feeding tray 20 for feeding recording paper stacked in the feeding tray 20 to the paper-conveying path 23. The feeding roller 25 is supported on an end of a feeding arm 26. A linefeed motor 71 (see FIG. 5) drives the feeding roller 25 to rotate with a driving force transmitted to the feeding roller 25 via a drive transmitting mechanism 27. The drive transmitting mechanism 27 includes a plurality of engaged gears.

The feeding arm 26 is rotatably supported on a base end 26*a*. When the feeding arm 26 pivots about the base end 26*a*, the feeding roller 25 moves vertically so as to contact and separate from the feeding tray 20. The feeding arm 26 is urged to rotate downward into contact with the feeding tray 20 by its own weight, a spring, or the like, and retracts upward when the feeding tray 20 is inserted or removed. When the feeding arm 26 is pivoted downward, the feeding roller 25 supported on the end of the feeding arm 26 contacts the recording paper in the feeding tray 20 with pressure. As the feeding roller 25 rotates in this position, a frictional force generated between the surface of the feeding roller 25 and the recording paper conveys the topmost sheet of the recording paper toward the sloped separating plate 22. The leading edge of this sheet of recording paper contacts the sloped separating plate 22 and is guided upward by the sloped separating plate 22 onto the paper-conveying path 23. In some cases, when the feeding roller 25 is conveying the topmost sheet of recording paper, friction or static electricity between the topmost sheet and the underlying sheet causes the underlying sheet to be conveyed together with the topmost sheet. However, the underlying sheet is restrained when contacting the sloped separating plate 22.

Excluding the section in which the image-recording unit 24 and the like are provided, the paper-conveying path 23 is configured of an outer guide surface and an inner guide surface that oppose each other with a prescribed gap formed therebetween. For example, a curved section 17 of the paper-conveying path 23 may be configured near the rear side of the multifunction device 1 by fixing an outer guide member 18 and an inner guide member 19 to a frame of the multifunction device 1. Rollers 16 are provided along the paper-conveying path 23, and particularly in the curved section of the paper-conveying path 23. The rollers 16 are rotatably provided on axes extending in the width direction of the paper-conveying path 23 The surfaces of the rollers 16 are exposed from the outer guide surface. These rollers 16 facilitate the smooth conveyance of recording paper in the curved section of the paper-conveying path 23.

As shown in FIG. 3, the image-recording unit 24 is disposed on the paper-conveying path 23. The image-recording unit 24 includes a carriage 38 that reciprocates in the main scanning direction, and an inkjet recording head 39 mounted in the carriage 38. Ink cartridges disposed in the multifunction device 1 independently of the inkjet recording head 39 supply ink in the colors cyan (C), magenta (M), yellow (Y), and black (Bk) to the inkjet recording head 39 via ink tubes 41 (see FIG. 4) While the carriage 38 reciprocates, microdroplets of ink in these colors are selectively ejected from the inkjet recording head 39 onto the recording paper conveyed over the platen 42 to record an image on the paper. Note that the ink cartridge is not shown in FIGS. 3 and 4.

Figure 4:
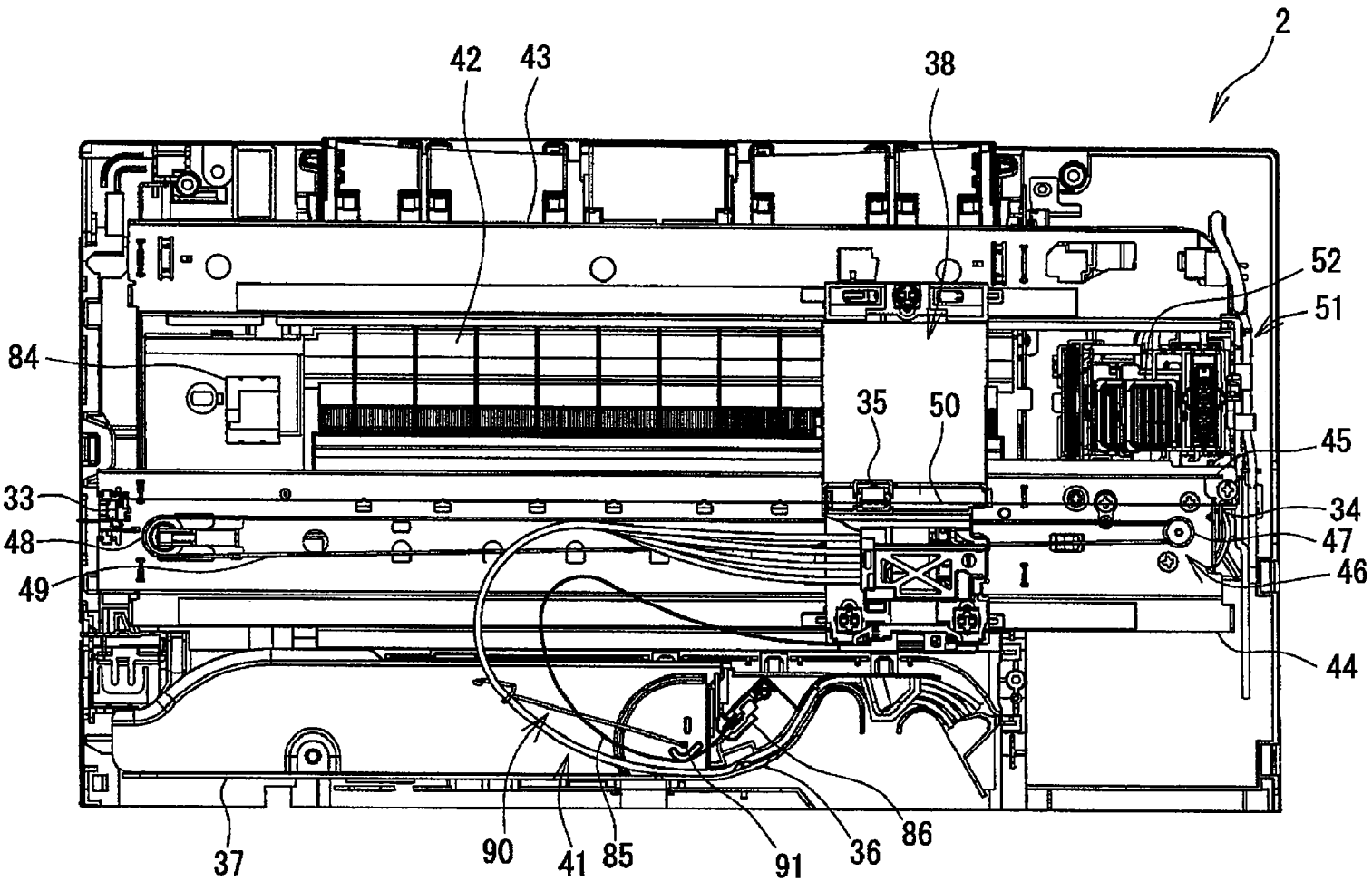
FIG. 4 is a plan view of a printer section in the multifunction device of the first embodiment.

FIG. 4 is a plan view showing the principal structure of the printer section 2, and primarily the structure from approximately the center of the printer section 2 to the rear surface side thereof. FIG. 4 is a perspective view showing the structure of the image-recording unit 24 in the printer section 2.

Figure 5:
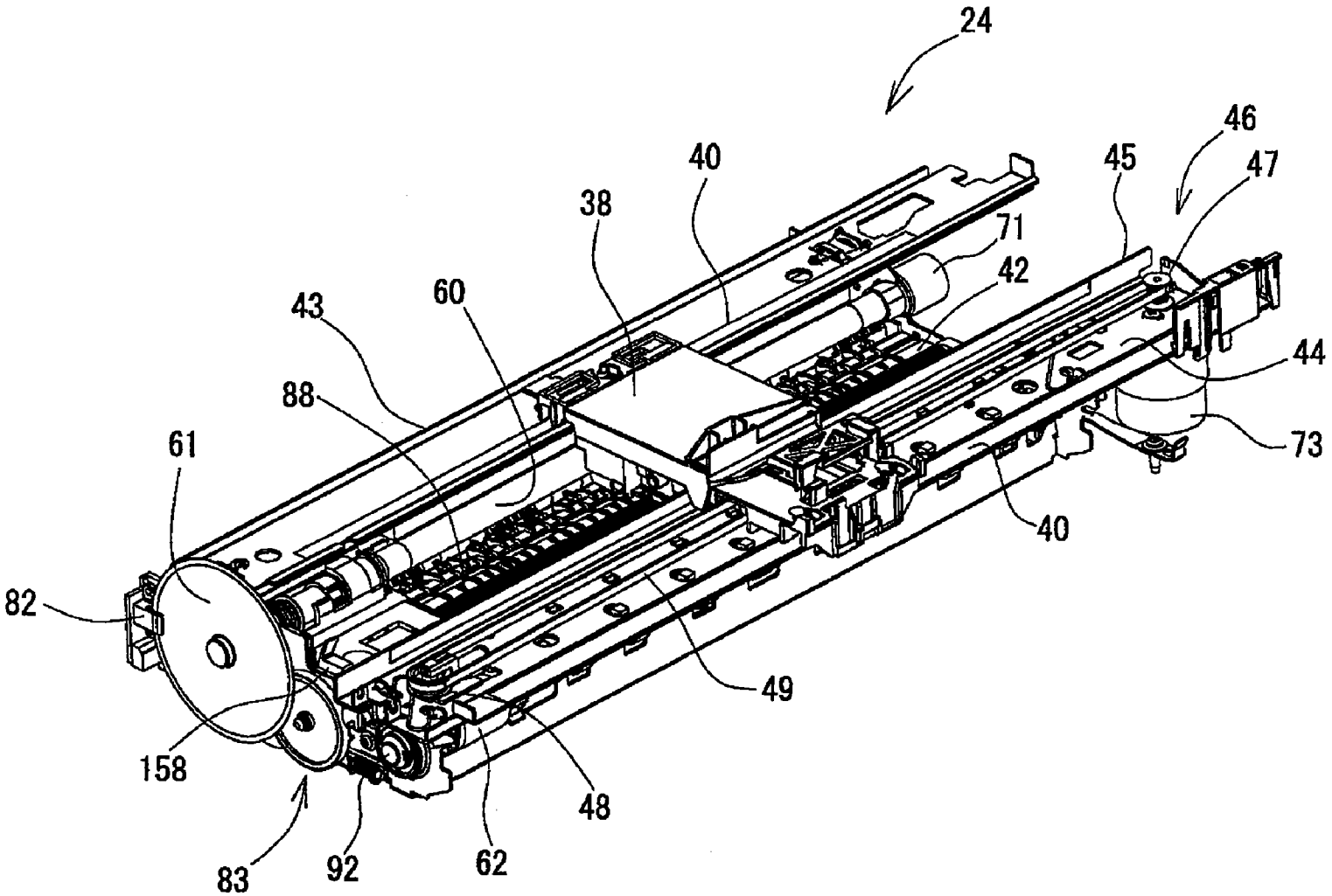
FIG. 5 is a perspective view of a printer section in the multifunction device of the first embodiment.

As shown in FIGS. 4 and 5, a pair of guide rails 43 and 44 is disposed above the paper-conveying path 23. The guide rails 43 and 44 are disposed at a prescribed distance from each other in the paper-conveying direction (from top to bottom in FIG. 4) and extend in a direction orthogonal to the paper-conveying direction (left-to-right direction in FIG. 4) The guide rails 43 and 44 are disposed inside the casing of the printer section 2 and constitute part of the frame supporting components of the printer section 2. The carriage 38 is disposed across both the guide rails 43 and 44 so as to be capable of sliding in a direction orthogonal to the paper-conveying direction. Accordingly, the guide rails 43 and 44 are disposed so as to be substantially horizontal and are juxtaposed in the paper-conveying direction, thereby decreasing the height of the printer section 2 and achieving a thinner device.

The guide rail 43 disposed on the upstream side of the guide rail 44 in the paper-conveying direction is plate-shaped with a dimension in the width direction of the paper-conveying path 23 (left-to-right direction in FIG. 4) greater than the reciprocating range of the carriage 38. The guide rail 44 disposed on the downstream side is also plate-shaped with a dimension in the width direction of the paper-conveying path 23 substantially the same as that of the guide rail 43. The carriage 38 is capable of sliding in the longitudinal direction of the guide rails 43 and 44 with an upstream end of the carriage 38 supported on the guide rail 43 and a downstream end supported on the guide rail 44.

The guide rail 44 has an edge part 45 bent upward at substantially a right angle from the upstream side of the guide rail 44. The carriage 38 supported on the guide rails 43 and 44 has a pair of rollers or other gripping members for slidably gripping the edge part 45. Hence, the carriage 38 can slide in a direction orthogonal to the paper-conveying direction, while being positioned relative to the paper-conveying direction. In other words, the carriage 38 is slidably supported on the guide rails 43 and 44 and is capable of reciprocating in a direction orthogonal to the paper-conveying direction with the edge part 45 of the guide rail 44 serving as a positional reference. Although not shown in the drawings, a lubricating agent such as grease is applied to the edge part 45 to facilitate sliding of the carriage 38.

A belt drive mechanism 46 is provided on the top surface of the guide rail 44. The belt drive mechanism 46 is configured of a drive pulley 47 and a follow pulley 48 disposed near widthwise ends of the paper-conveying path 23, and an endless timing belt 49 stretched around the drive pulley 47 and follow pulley 48 and having teeth on the inside surface thereof. A carriage motor 73 (see FIG. 5) generates a driving force that is transmitted to the shaft of the drive pulley 47 for rotating the drive pulley 47. The rotation of the drive pulley 47 causes the timing belt 49 to move circuitously. Although the timing belt 49 is an endless belt in the preferred embodiment, a belt having ends may also be used by fixing both ends to the carriage 38.

The bottom surface of the carriage 38 is fixed to the timing belt 49 so that the circuitous movement of the timing belt 49 causes the carriage 38 to reciprocate over the guide rails 43 and 44 while the edge part 45 maintains the position of the carriage 38 relative to the paper-conveying direction. The inkjet recording head 39 is mounted in the carriage 38 having this construction so that the inkjet recording head 39 also reciprocates in the width direction of the paper-conveying path 23. Here, the width direction of the paper-conveying path 23 is the main scanning direction.

As shown in FIG. 4, an encoder strip 50 for a linear encoder 77 (see FIG. 8) is provided along the guide rail 44. The encoder strip 50 is a strip-like member formed of a transparent resin. A pair of support parts 33 and 34 is formed on the top surface of the guide rail 44, with one disposed on each widthwise end of the guide rail 44 (each end in the reciprocating direction of the carriage 38). The encoder strip 50 extends over the edge part 45 with the ends of the encoder strip 50 engaged in the support parts 33 and 34. While not shown in the drawings, one of the support parts 33 and 34 has a leaf spring for engaging the end of the encoder strip 50. The leaf spring prevents slack in the encoder strip 50 by applying tension to the encoder strip 50 in the longitudinal direction, while being elastically deformable so that the encoder strip 50 can bend when an external force is applied thereto.

Light-transmitting parts allowing the passage of light and light-blocking parts preventing the passage of light are alternately disposed along the length of the encoder strip 50 at a prescribed pitch. An optical sensor 35 configured of a transmission sensor is disposed on the top surface of the carriage 38 at a position opposing the encoder strip 50. The optical sensor 35 reciprocates together with the carriage 38 along the length of the encoder strip 50 and detects the pattern formed on the encoder strip 50. A head controlling circuit board is provided in the inkjet recording head 39 for controlling ink ejection. The head controlling circuit board outputs a pulse signal based on detection signals from the optical sensor 35. By determining the position of the carriage 38 based on this pulse signal, it is possible to control the reciprocating motion of the carriage 38. The head controlling circuit board is covered by a head cover of the carriage 38 and is therefore not visible in FIGS. 4 and 5.

As shown in FIGS. 3 and 4, the platen 42 is disposed on the bottom of the paper-conveying path 23 opposing the inkjet recording head 39. The platen 42 spans a central portion within the reciprocating range of the carriage 38 through which the recording paper passes. The width of the platen 42 is sufficiently larger than the maximum width of recording paper that can be conveyed in the multifunction device 1 so that both widthwise edges of the recording paper pass over the platen 42. The platen 42 is provided with a movable support piece 88 (see FIG. 5) described in detail later. The movable support piece 88 follows the movement of the recording paper in the paper-conveying direction as the recording paper is conveyed over the platen 42, thereby maintaining support of the edges of the recording paper at all times.

As shown in FIG. 4, a maintenance unit including a purge mechanism 51 and a waste ink tray 84 is provided in a region through which the recording paper does not pass, that is, in a region outside the image-recording range of the inkjet recording head 39. The purge mechanism 51 functions to draw out air bubbles and foreign matter from nozzles 53 (see FIG. 6) in the inkjet recording head 39. The purge mechanism 51 includes a cap 52 for covering the nozzles 53, a pump mechanism (not shown) connected to the inkjet recording head 39 via the cap 52, and a moving mechanism (not shown) for moving the cap 52 to contact or separate from the nozzles 53 of the inkjet recording head 39. In FIG. 4, the pump mechanism and the moving mechanism are positioned beneath the guide rail 44 and are therefore not visible.

When an operation is performed to remove air bubbles and the like from the inkjet recording head 39, the carriage 38 is moved so that the inkjet recording head 39 is positioned above the cap 52. Subsequently, the moving mechanism moves the cap 52 upward against the inkjet recording head 39 so as to form a seal over the nozzles 53 formed in the bottom surface of the inkjet recording head 39. The pump mechanism then generates negative pressure in the cap 52 to draw out ink and air bubbles and foreign matter included in the ink from the nozzles 53.

The waste ink tray 84 is disposed on the top surface of the platen 42 outside of the image-recording range, but within the reciprocating range of the carriage 38 for receiving ink that has been flushed out of the inkjet recording head 39. The inside of the waste ink tray 84 is lined with felt for absorbing and holding the flushed ink. The maintenance unit having this construction can perform such maintenance as removing air bubbles and mixed ink of different colors from the inkjet recording head 39, and preventing the inkjet recording head 39 from drying out.

As shown in FIG. 1, a door 7 is provided on the front surface of the printer section 2 casing and is capable of opening and closing over the same. Opening the door 7 exposes a cartridge mounting section on the front side of the printer section 2, enabling the user to mount ink cartridges in or remove ink cartridges from the cartridge mounting section. While not shown in the drawings, the cartridge mounting section is partitioned into four accommodating chambers for individually accommodating ink cartridges filled with ink of the colors cyan, magenta, yellow, and black. Four ink tubes 41 corresponding to the four ink colors lead from the cartridge accommodating section to the carriage 38 As described above, ink is supplied from the ink cartridges mounted in the cartridge accommodating section to the inkjet recording head 39 mounted on the carriage 38 via the ink tubes 41.

The ink tubes 41 are tubes formed of synthetic resin and are flexible so as to be able to bend when the carriage 38 reciprocates. As shown in FIG. 4, the ink tubes 41 extend from the cartridge accommodating section along the width direction of the device to a position near the center thereof, at which position the ink tubes 41 are fixed to a fixing clip 36 on the body of the device. A section of the ink tubes 41 from the fixing clip 36 to the carriage 38 forms a U-shaped curved that is not fixed to the device body or the like. This U-shaped section changes in shape as the carriage 38 reciprocates. The section of the ink tubes 41 extending from the fixing clip 36 to the cartridge mounting section is not shown in FIG. 4.

Specifically, the section of the ink tubes 41 between the fixing clip 36 and carriage 38 leads in one direction along the reciprocating path of the carriage 38 and subsequently reverses directions, forming a curved section. In other words, this section of the ink tubes 41 is substantially U-shaped in a plan view. At the carriage 38, the four ink tubes 41 are horizontally juxtaposed along the paper-conveying direction and extend in the reciprocating direction of the carriage 38. However, the four ink tubes 41 are arranged vertically at the fixing clip 36 to facilitate fixation. The fixing clip 36 has a U-shaped cross-section open on the top. The vertically stacked ink tubes 41 are inserted through this opening and are integrally held by the fixing clip 36. In this way, the four ink tubes 41 curve along a U-shaped path from the carriage 38 to the fixing clip 36 while twisting from a horizontally juxtaposed relationship to a vertically juxtaposed relationship.

The four ink tubes 41 have substantially the same length from the carriage 38 to the fixing clip 36. The ink tube 41 positioned farthest upstream in the paper-conveying direction at the carriage 38 is positioned on the top at the fixing clip 36. The ink tube 41 disposed next in order from the upstream side at the carriage 38 is disposed next in order vertically at the fixing clip 36. This process is repeated so that the ink tubes 41 arranged from the upstream side to the downstream side in the paper-conveying direction at the carriage 38 are arranged in order from top to bottom at the fixing clip 36. Being substantially equivalent in length, the ink tubes 41 curve so that the center of the curved section of each ink tube 41 is offset in the paper-conveying direction according to the order in which the ink tubes 41 are juxtaposed in the paper-conveying direction. As a result, the four ink tubes 41 have a vertically sloped arrangement in the curved section, thereby minimizing interference among the ink tubes 41 as the ink tubes 41 change shape to follow the reciprocating motion of the carriage 38. In the preferred embodiment, four of the ink tubes 41 are provided. However, even if the number of the ink tubes 41 is increased, the ink tubes 41 can be arranged in the same juxtaposed relationship, with the ink tube 41 disposed farthest upstream in the paper-conveying direction at the carriage 38 positioned on top at the fixing clip 36.

A flat cable 85 transfers recording signals and the like from a main circuit board constituting a controller 64 (see FIG. 8) to a head control circuit board in the inkjet recording head 39. While not shown in FIG. 4, the main circuit board is disposed near the front of the printer section 2 (the near side in FIG. 4). The flat cable 85 is an insulated ribbon cable configured of conductors for transmitting electric signals, the conductors being coated in a synthetic resin film such as a polyester film or the like. The flat cable 85 electrically connects the main circuit board to the head control circuit board.

The flat cable 85 is flexible and bends in response to the reciprocation of the carriage 38. As shown in FIG. 4, the flat cable 85 extends from the carriage 38 in one direction along the reciprocating path of the carriage 38, and subsequently reverses directions and extends to a fixing clip 86, thereby forming a curved section. In other words, the flat cable 85 follows a path that is substantially U-shaped in a plan view with the top and bottom surfaces of the ribbon shape oriented vertically. In other words, the top and bottom surfaces of the flat cable 85 fall in vertical planes, while a normal to these surfaces is oriented horizontally. Further, the direction in which the flat cable 85 extends from the carriage 38 and the extending direction of the ink tubes 41 are identical to the reciprocating direction of the carriage 38 The end of the flat cable 85 fixed to the carriage 38 is electrically connected to the head control circuit board mounted in the carriage 38. The other end of the flat cable 85 fixed to the fixing clip 86 extends to and is electrically connected to the main circuit board. The section of the flat cable 85 curved in a U shape is not fixed to any member, but changes in shape as the carriage 38 reciprocates, similar to the ink tubes 41. A rotating support member 90 is provided for supporting the ink tubes 41 and flat cable 85 as these components change in shape when the carriage 38 reciprocates. The rotating support member 90 is rotatably supported on a shaft-receiving part 91 at one end thereof. Hence, the rotating support member 90 is capable of pivoting about the shaft-receiving part 91.

A restricting wall 37 is provided on the front surface of the printer section 2 extending in the width direction (left-to-right direction in FIG. 4) The restricting wall 37 has a vertical surface that is contacted by the ink tubes 41 and extends along a straight line following the reciprocating direction of the carriage 38. The restricting wall 37 is disposed in the area that the ink tubes 41 extend from the fixing clip 36 and is set to a height sufficient for all four ink tubes 41 juxtaposed vertically to contact. The ink tubes 41 extend from the fixing clip 36 along the restricting wall 37. By contacting the inside surface of the restricting wall 37, the ink tubes 41 are restricted from expanding in a direction toward the front surface of the printer section 2, that is, away from the carriage 38.

The fixing clip 36 is disposed near the widthwise center of the printer section 2. The fixing clip 36 fixes the ink tubes 41 so that the ink tubes 41 extend toward the restricting wall 37. More specifically, the vertical surface of the restricting wall 37 and the direction in which the ink tubes 41 extend from the fixing clip 36 forms an obtuse angle less than 180 degrees in a plan view. The ink tubes 41 are flexible, but have a degree of stiffness (flexural rigidity). Hence, the ink tubes 41 press against the surface of the restricting wall 37 when extending at an angle from the fixing clip 36 to the restricting wall 37. Consequently, the range in which the ink tubes 41 follow the restricting wall 37 expands within the reciprocating range of the carriage 38, thereby reducing the area in the section from the curved section of the ink tubes 41 to the carriage 38 that expands toward the carriage 38.

The fixing clip 86 is disposed near the widthwise center of the printer section 2 further inside than the fixing clip 36. The fixing clip 86 fixes the flat cable 85 so that the flat cable 85 expands toward the restricting wall 37. Hence, the vertical surface of the restricting wall 37 and the direction in which the flat cable 85 extends from the fixing clip 86 forms an obtuse angle smaller than 180 degrees in a plan view. The flat cable 85 is flexible, but has a degree of stiffness (flexural rigidity). Hence, the flat cable 85 presses against the surface of the restricting wall 37 when extending at an angle from the fixing clip 86 to the restricting wall 37. Consequently, the range in which the flat cable 85 follows the restricting wall 37 expands within the reciprocating range of the carriage 38, thereby reducing the area in the section from the curved section of the flat cable 85 to the carriage 38 that expands toward the carriage 38.

Figure 6:
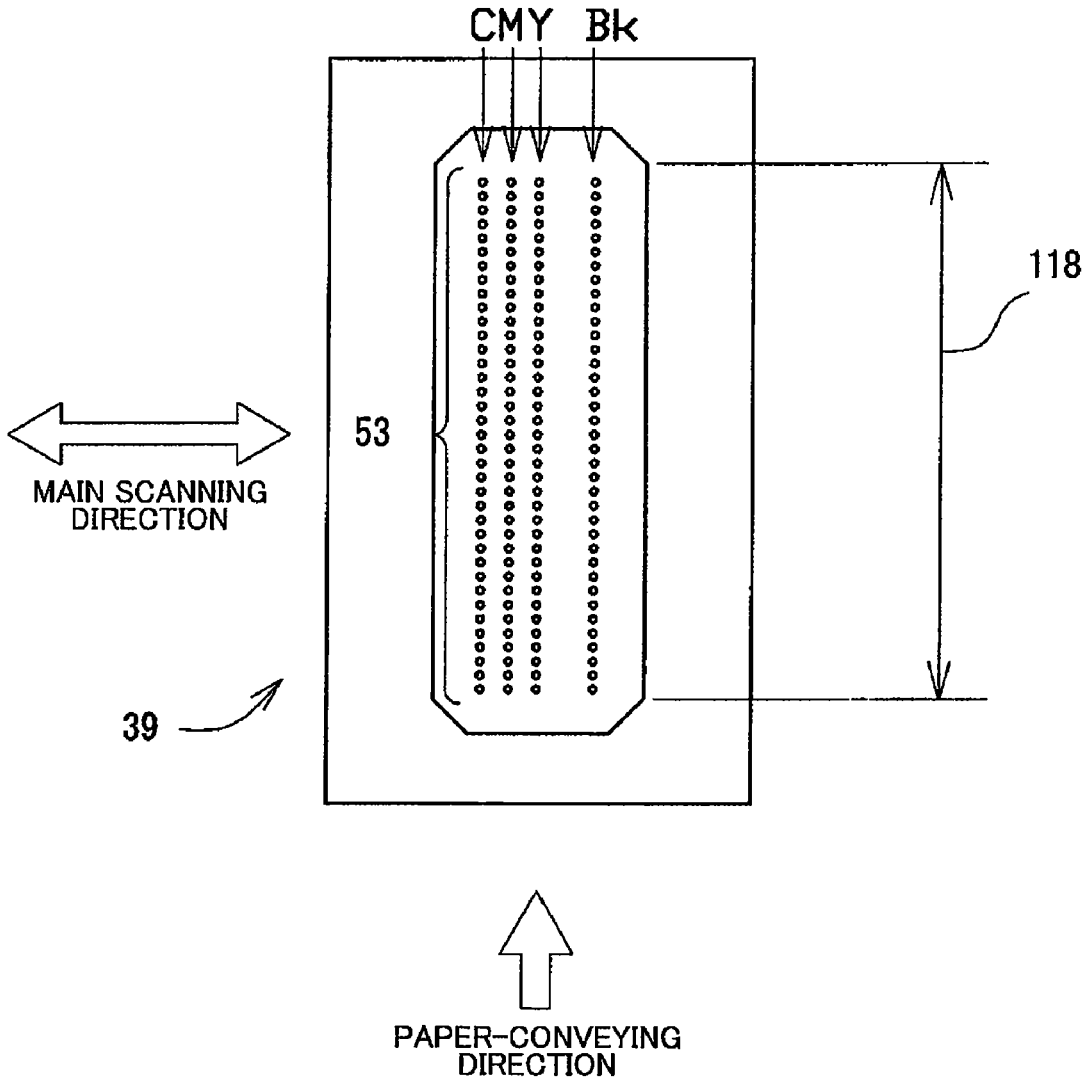
FIG. 6 is an enlarged bottom view of an inkjet recording head in the multifunction device of the first embodiment.

FIG. 6 is a bottom view of the inkjet recording head 39 showing the nozzle surface.

As shown in FIG. 6, the nozzles 53 are formed in the bottom surface of the inkjet recording head 39 in rows extending in the paper-conveying direction for each of the ink colors cyan, magenta, yellow, and black. The paper-conveying direction is vertically upward in FIG. 6, while the main scanning direction of the carriage 38 is left-to-right. A row of nozzles 53 is formed for each of the ink colors in the paper-conveying direction, and the rows are juxtaposed in the main scanning direction of the carriage 38. The pitch and number of the nozzles 53 arranged in the paper-conveying direction for each color are set appropriately with consideration for the resolution of the images to be recorded and the like. It is also possible to increase or decrease the number of rows of the nozzles 53 to correspond to the number of ink colors.

Figure 7:
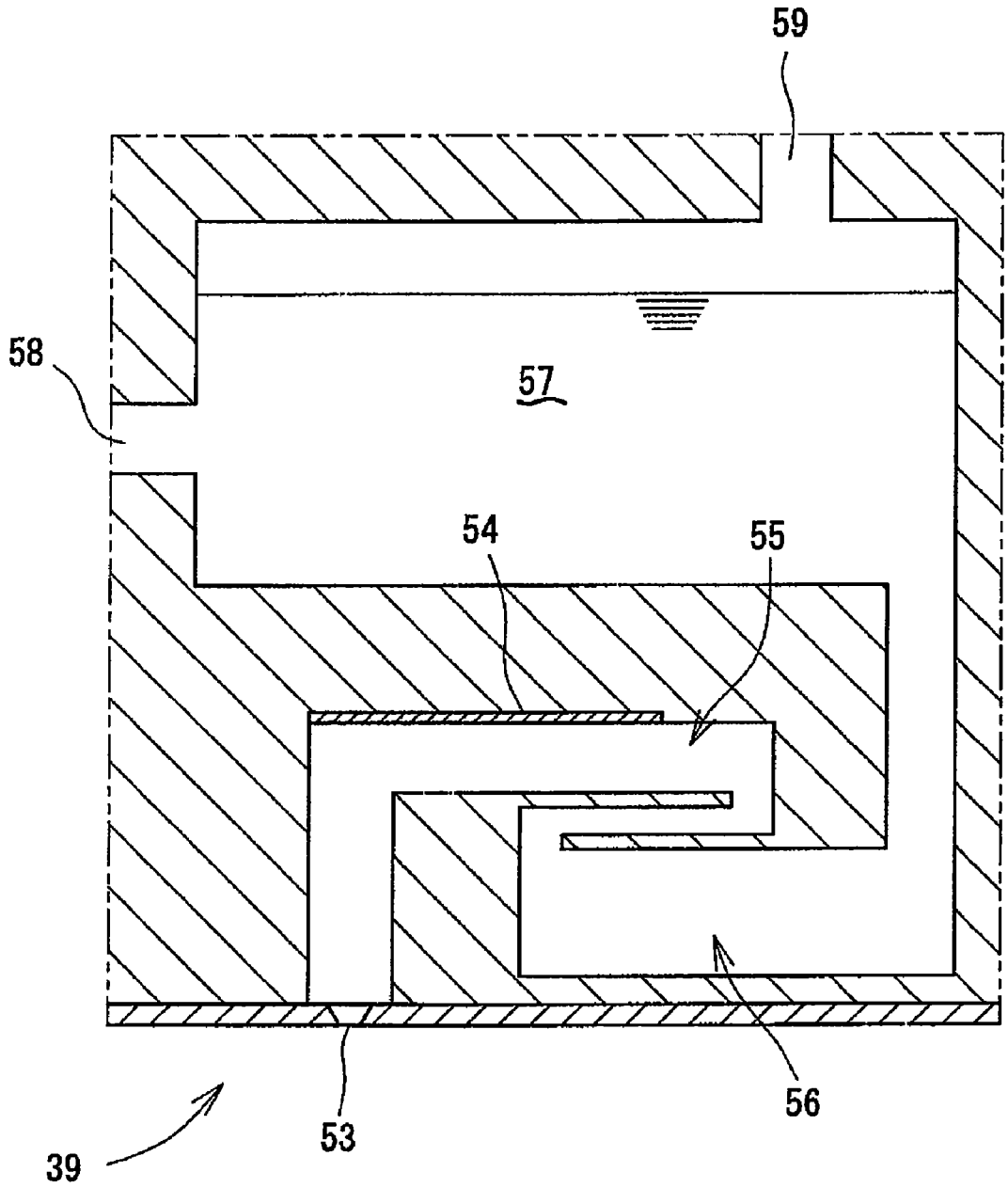
FIG. 7 is an enlarged cross-sectional view showing the internal structure of the inkjet recording head in the multifunction device of the first embodiment.

FIG. 7 is an enlarged cross-sectional view showing part of the internal structure of the inkjet recording head 39, As shown in FIG. 7, a cavity 55 is formed in the inkjet recording head 39 upstream of the nozzle 53 for each nozzle 53 formed in the bottom surface of the inkjet recording head 39. Each cavity 55 is provided with a piezoelectric element 54 that deforms to shrink the capacity of the cavity 55 when a prescribed voltage is applied thereto. Changes in the volume of the cavity 55 cause ink accommodated in the cavity 55 to eject from the nozzle 53 as an ink droplet.

While the cavity 55 is provided for each nozzle 53, a single manifold 56 is formed along the plurality of cavities 55. The manifold 56 is provided for each of the colors cyan, magenta, yellow, and black. A buffer tank 57 is provided upstream of the cavity 55. One buffer tank 57 is provided for each color cyan, magenta, yellow, and black. An ink supply opening 58 is formed in a side wall of the buffer tank 57 for supplying ink from the ink tubes 41 into the buffer tank 57. By temporarily storing ink in the buffer tank 57, air bubbles generated in the ink in the ink tubes 41 are captured and prevented from entering the cavity 55 and manifold 56. The pump mechanism removes air bubbles captured in the buffer tank 57 by suction via an air bubble outlet 59. Ink supplied from the buffer tank 57 to the manifold 56 is distributed by the manifold 56 to each of the cavities 55.

This construction forms an ink channel by which ink of the respective color supplied from the respective ink cartridge via the ink tube 41 flows to the cavity 55 via the buffer tank 57 and manifold 56. In this way, ink of each color cyan, magenta, yellow, and black supplied via these ink channels is subsequently ejected from the nozzle 53 onto recording paper as ink droplets when the piezoelectric element 54 deforms.

As shown in FIG. 3, a conveying roller 60 and a pinch roller are disposed on the upstream side of the image-recording unit 24 while hidden from view by other components in FIG. 3, the pinch roller contacts the bottom side of the conveying roller 60 with pressure. The conveying roller 60 and the pinch roller receive and pinch a sheet of recording paper conveyed along the paper-conveying path 23 and convey the recording paper over the platen 42. Pairs of discharge rollers 62 and spur rollers 63 are disposed on the downstream side of the image-recording unit 24 for pinching and conveying the recording paper to the discharge tray 21 after an image has been recorded on the recording paper. A driving force transmitted from the linefeed motor 71 drives the conveying roller 60 and discharge rollers 62 intermittently at prescribed linefeed amounts. Rotation of the conveying roller 60 and discharge rollers 62 is synchronized. Further, a rotary encoder 76 (see FIG. 8) is provided on the conveying roller 60, and has an optical sensor 82 (see FIG. 5) for detecting a pattern on an encoder disk 61 rotating together with the conveying roller 60. The rotation of the conveying roller 60 and discharge rollers 62 is controlled based on detection signals from the rotary encoder 76.

Since the spur rollers 63 press against paper that has been printed, the roller surface of the spur rollers 63 is shaped like a spur with alternating protruding and depressed parts so as to not degrade the image recorded on the paper. The spur rollers 63 are capable of sliding in a direction for contacting or separating from the discharge rollers 62. A coil spring urges the spur rollers 63 to press against the discharge rollers 62. When recording paper becomes interposed between the discharge rollers 62 and spur rollers 63, the spur rollers 63 recede against the urging force of the coil spring by a distance equivalent to the thickness of the recording paper, while pressing the recording paper against the discharge rollers 62. In this way, the rotational force of the discharge rollers 62 is reliably transmitted to the recording paper. The pinch roller is similarly provided against the conveying roller 60, pressing the recording paper against the conveying roller 60 so that the rotational force of the conveying roller 60 is reliably transmitted to the recording paper.

A registration sensor 95 is disposed on the paper-conveying path 23 upstream of the conveying roller 60. The registration sensor 95 includes a probe shown in FIG. 3, and an optical sensor (not shown). The probe is capable of protruding into and retracting from the paper-conveying path 23 and is elastically urged to protrude into the paper-conveying path 23 at all times. When a sheet of recording paper conveyed along the paper-conveying path 23 contacts the probe, the probe rotates out of the paper-conveying path 23. The protruding and retracting motion of the probe switches the optical sensor on and off. Therefore, the position of the leading or trailing edge of the recording paper in the paper-conveying path 23 is detected based on the protruding and retracting of the probe.

In addition to feeding recording paper from the feeding tray 20, the linefeed motor 71 in the multifunction device 1 of the preferred embodiment functions to convey recording paper to a position over the platen 42 and to discharge recording paper onto the discharge tray 21 after recording has completed. In other words, the linefeed motor 71 drives the conveying roller 60 (see FIG. 5), drives the feeding roller 25 via the drive transmitting mechanism 27 as described above (see FIG. 3), and drives a discharge roller shaft on which the discharge rollers 62 are mounted via a drive transmitting mechanism 83 (see FIG. 5) The drive transmitting mechanism 83 may be configured of a gear train, for example, or a timing belt suitable for the mounting space available.

Figure 8:
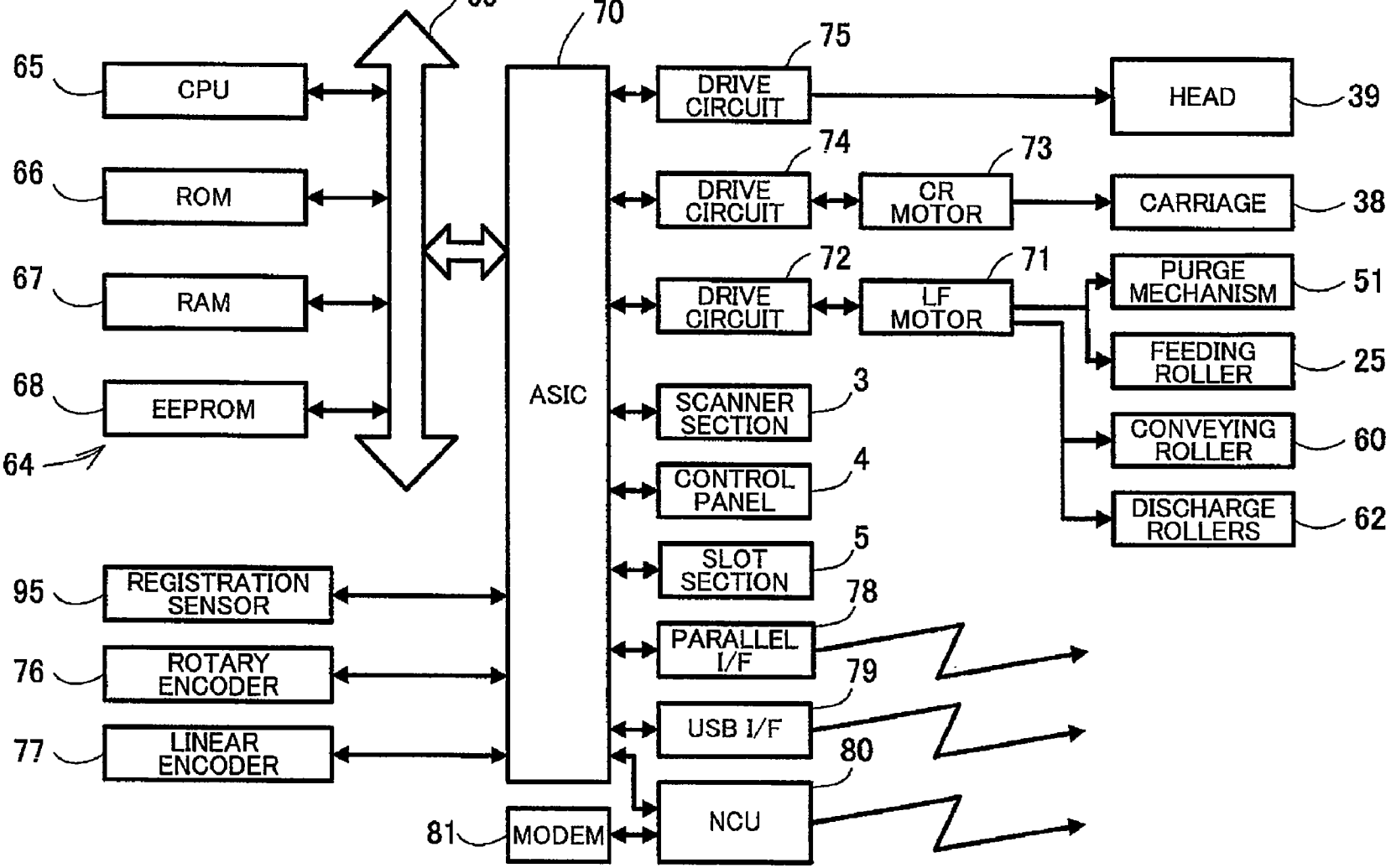
FIG. 8 is a block diagram showing the structure of a controller in the multifunction device of the first embodiment.

FIG. 8 is a block diagram showing the structure of the controller 64 for the multifunction device 1.

The controller 64 controls the overall operations of the multifunction device 1, including not only the scanner section 3, but also the printer section 2. The controller 64 is configured of a main circuit board connected to the flat cable 85. Since the structure of the scanner section 3 is not important in the present invention, a detailed description of this structure has been omitted.

As shown in FIG. 8, the controller 64 is configured of a microcomputer primarily including a CPU (central processing unit) 65, a ROM (read only memory) 66, a RAM (random access memory) 67, and a EEPROM (electrically erasable and programmable ROM) 68. These components are connected to an ASIC (application specific integrated circuit) 70 via a bus 69.

The ROM 66 stores programs and the like for controlling various operations of the multifunction device 1. The RAM 67 functions as a storage area or a work area for temporarily saving various data used by the CPU 65 in executing the programs. The EEPROM 68 stores settings, flags, and the like that must be preserved when the power is turned off.

On a command from the CPU 65, the ASIC 70 generates a phase excitation signal and the like for conducting electricity to the linefeed motor 71. The signal is applied to a drive circuit 72 of the linefeed motor 71. By supplying a drive signal to the linefeed motor 71 via the drive circuit 72, the ASIC 70 can control the rotation of the linefeed motor 71.

The drive circuit 72 drives the linefeed motor 71, which is connected to the feeding roller 25, conveying roller 60, discharge rollers 62, and purge mechanism 51. Upon receiving an output signal from the ASIC 70, the drive circuit 72 generates an electric signal for rotating the linefeed motor 71. When the linefeed motor 71 rotates, the rotational force of the linefeed motor 71 is transferred to the feeding roller 25, conveying roller 60, discharge rollers 62, and purge mechanism 51 via a drive mechanism well known in the art that includes gears, drive shafts, and the like. In other words, in addition to feeding recording paper from the feeding tray 20, the linefeed motor 71 in the multifunction device 1 of the preferred embodiment functions to convey recording paper to a position over the platen 42 and to discharge recording paper onto the discharge tray 21 after recording is completed.

Similarly, upon receiving a command from the CPU 65, the ASIC 70 generates a phase excitation signal and the like for supplying electricity to the carriage motor 73 and applies this signal to a drive circuit 74 of the carriage motor 73. By supplying a drive signal to the carriage motor 73 via the drive circuit 74, the ASIC 70 can control the rotation of the carriage motor 73.

The drive circuit 74 functions to drive the carriage motor 73. Upon receiving an output signal from the ASIC 70, the drive circuit 74 generates an electric signal for rotating the carriage motor 73. When the carriage motor 73 rotates, the rotational force of the carriage motor 73 is transferred to the carriage 38 via the belt drive mechanism 46, thereby scanning the carriage 38 in a reciprocating motion. In this way, the controller 64 can control the reciprocation of the carriage 38.

A drive circuit 75 is provided for driving the inkjet recording head 39 at a prescribed timing. The ASIC 70 generates and outputs a signal to the drive circuit 75 based on a drive control procedure received from the CPU 65. The drive circuit 75 drives the inkjet recording head 39 based on the output signal received from the ASIC 70. The drive circuit 75 is mounted in the head control circuit board. When an output signal is transferred from the main circuit board constituting the controller 64 to the head control circuit board via the flat cable 85, the drive circuit 75 drives the inkjet recording head 39 to selectively eject ink of each color onto the recording paper at a prescribed timing.

The ASIC 70 is also connected to the rotary encoder 76 for detecting the rotated amount of the conveying roller 60, the linear encoder 77 for detecting the position of the carriage 38, and the registration sensor 95 for detecting the leading and trailing edges of the recording paper. When the power of the multifunction device 1 is turned on, the carriage 38 is moved to one end of the guide rails 43 and 44 and the detection position of the linear encoder 77 is initialized. When the carriage 38 moves from this initial position over the guide rails 43 and 44, the optical sensor 35 provided on the carriage 38 detects the pattern on the encoder strip 50 and outputs a pulse signal based on these detections The controller 64 determines the distance that the carriage 38 has moved based on the number of pulse signals. According to this detected movement, the controller 64 controls the rotation of the carriage motor 73 in order to control the reciprocating motion of the carriage 38. The controller 64 also determines the leading and trailing edge positions of recording paper based on a signal outputted from the registration sensor 95 and an encoder amount detected by the rotary encoder 76. When the leading edge of a sheet of recording paper arrives at a prescribed position on the platen 42, the controller 64 begins controlling the rotation of the linefeed motor 71 for conveying the recording paper intermittently at prescribed linefeed widths. The linefeed width is set based on a resolution and the like inputted as recording conditions.

The ASIC 70 is also connected to the scanner section 3; the control panel 4 for specifying operations of the multifunction device 1; the slot section 5 in which various small memory cards can be inserted; a parallel interface 78, a USB interface 79, and the like for exchanging data with a personal computer or other external device via a parallel cable or USB cable; and a NCU (network control unit) 80 and a modem 81 for implementing a facsimile function.

Figure 9:
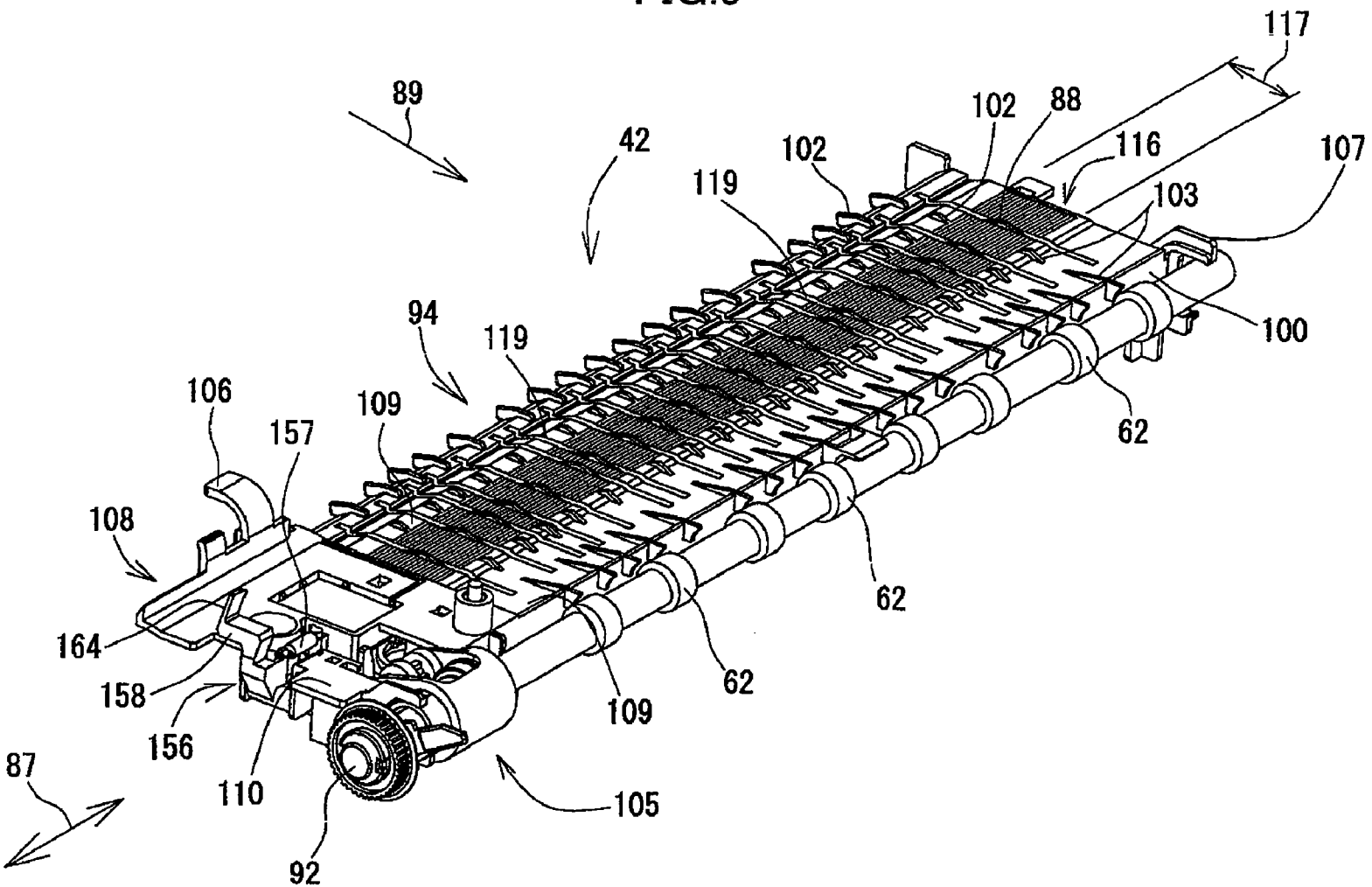
FIG. 9 is an enlarged perspective view of the printer section in FIG. 5.

FIG. 9 is an enlarged perspective view of the platen 42.

As described above, the platen 42 is disposed in opposition to the inkjet recording head 39 (below the inkjet recording head 39 in FIG. 3) for supporting recording paper during an image recording operation. As shown in FIG. 9, the platen 42 has an overall long, slender rectangular shape and a thin construction. The platen 42 is positioned with the longitudinal dimension along the main scanning direction, indicated by the arrow 87. The arrow 89 in the same drawing indicates the paper-conveying direction.

The platen 42 includes a frame 100; first fixed ribs 102 and second fixed ribs 103 disposed on the frame 100; the movable support piece 88 slidably provided on the frame 100; and the interlock mechanism 105 described later for sliding the movable support piece 88.

The frame 100 is formed of a synthetic resin or steel plate and constitutes the frame of the platen 42. The cross-section of the frame 100 is shaped similar to the letter C. Brackets 106 and 107 are disposed one on either end of the frame 100 in the main scanning direction. The brackets 106 and 107 are integrally formed with the frame 100. The frame 100 is fixed to the multifunction device 1 via the brackets 106 and 107.

A drive mechanism mounting section 108 is disposed on one end of the frame 100 (the near side in FIG. 9). The drive mechanism mounting section 108 is integrally formed with the frame 100 and includes a top plate 110 formed continuously with a top surface 109 of the frame 100. The top plate 110 is rectangular shaped and functions to support the interlock mechanism 105 described later.

The first fixed ribs 102 and second fixed ribs 103 are provided on the top surface 109 of the frame 100. More specifically, the first fixed ribs 102 are provided on an upstream end of the top surface 109 in the paper-conveying direction and protrude upward toward the inkjet recording head 39 The second fixed ribs 103 are provided on the downstream side of the top surface 109 in the paper-conveying direction and protrude upward. As shown in FIG. 9, the first fixed ribs 102 and second fixed ribs 103 in the preferred embodiment are divided into two parts in the paper-conveying direction, but obviously these components may be formed integrally rather than divided.

In the preferred embodiment, the first fixed ribs 102 are provided on the multifunction device 109 and juxtaposed in the main scanning direction. Similarly, the second fixed ribs 103 are provided on the top surface 109 and juxtaposed in the main scanning direction. With this construction, a groove 116 is formed between the first fixed ribs 102 and second fixed ribs 103. As shown in FIG. 9, the groove 116 extends in the main scanning direction and expands in the paper-conveying direction. The groove 116 has a width dimension 117 that corresponds to the size of the inkjet recording head 39. Specifically, the multifunction device 117 of the multifunction device 116 is set wider than an ink ejection range 118 (see FIG. 6) of the inkjet recording head 39.

In the preferred embodiment, the first fixed ribs 102 and second fixed ribs 103 oppose each other in the paper-conveying direction (the direction of the arrow 89) with the groove 116 interposed therebetween, as shown in FIG. 9. The corners of the first fixed ribs 102 are beveled to form a pair of sloped surfaces. In the preferred embodiment, sloped surfaces are formed in both corners of the first fixed ribs 102 with respect to the paper-conveying direction. However, it is also possible to form a sloped surface in only the upstream corner of the first fixed ribs 102 in the paper-conveying direction. Similarly, the corners of the second fixed ribs 103 are beveled to form a pair of sloped surfaces. While sloped surfaces are formed in both corners of the second fixed ribs 103 with respect to the paper-conveying direction, it is also possible to form a sloped surface in only the upstream corner of the second fixed ribs 103 in the paper-conveying direction.

A plurality of slits 119 are formed in the top surface 109 of the frame 100. The slits 119 extend from the upstream end to the downstream end of the top surface 109 in the paper-conveying direction and are juxtaposed in the main scanning direction. Each slit 119 extends from the region between neighboring first fixed ribs 102 to the region between neighboring second fixed ribs 103. The movable support piece 88 is fitted into the slits 119 and protrudes upward therefrom.

Figure 10:
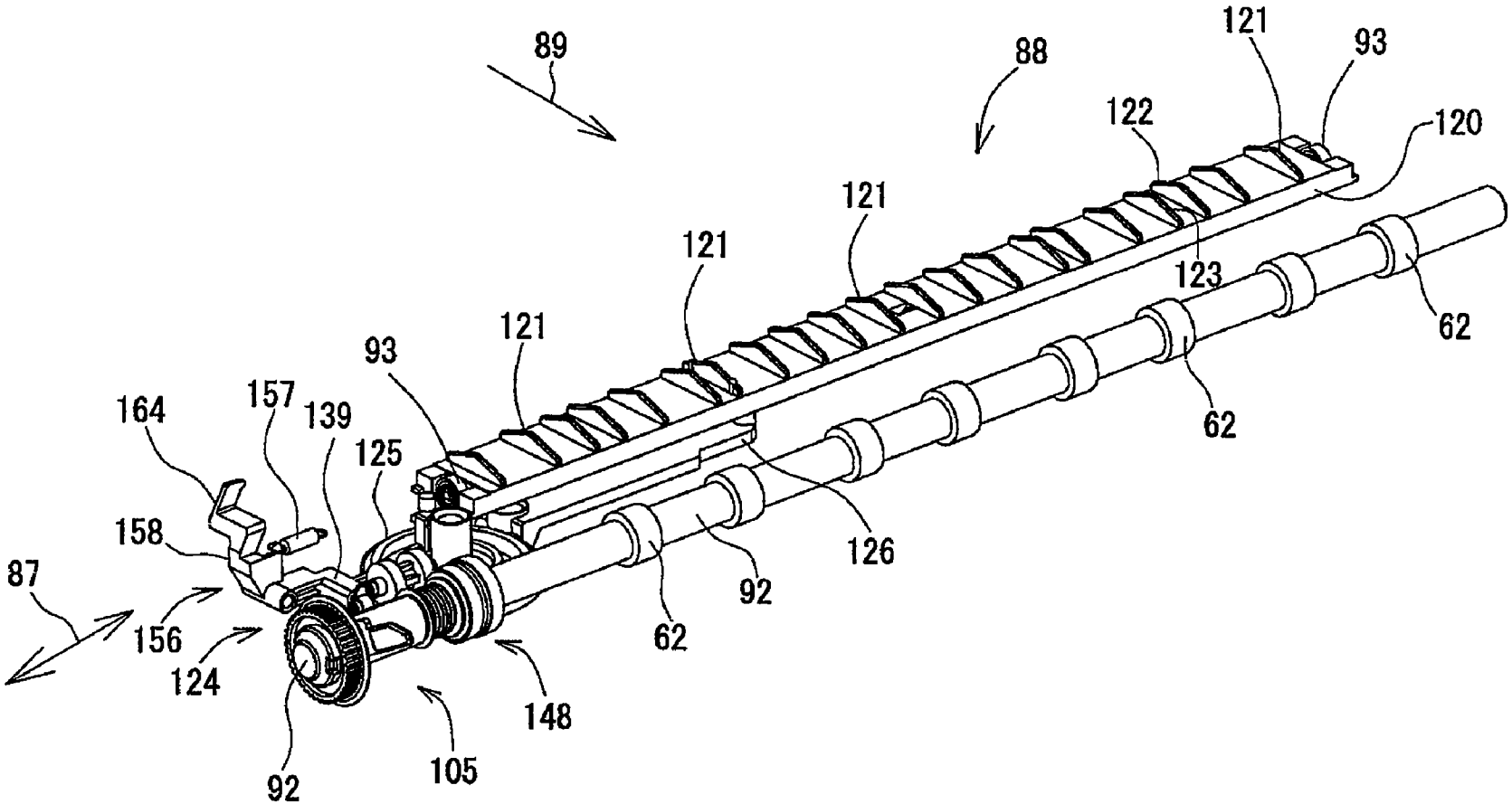
FIG. 10 is an enlarged perspective view of a movable support piece in the multifunction device of the first embodiment.
Figure 11:
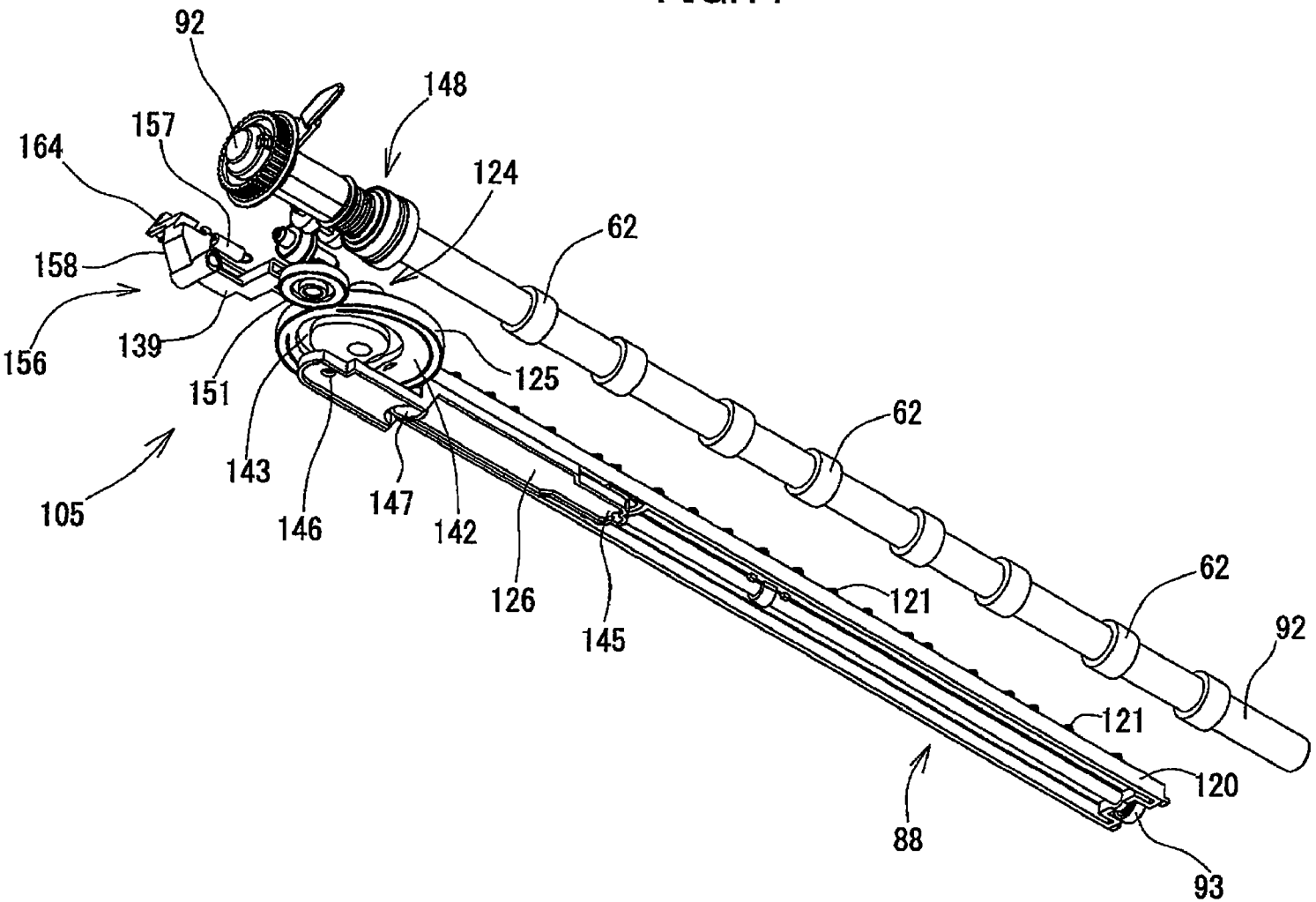
FIG. 11 is an enlarged perspective view of the movable support piece in the multifunction device of the first embodiment.
Figure 12:
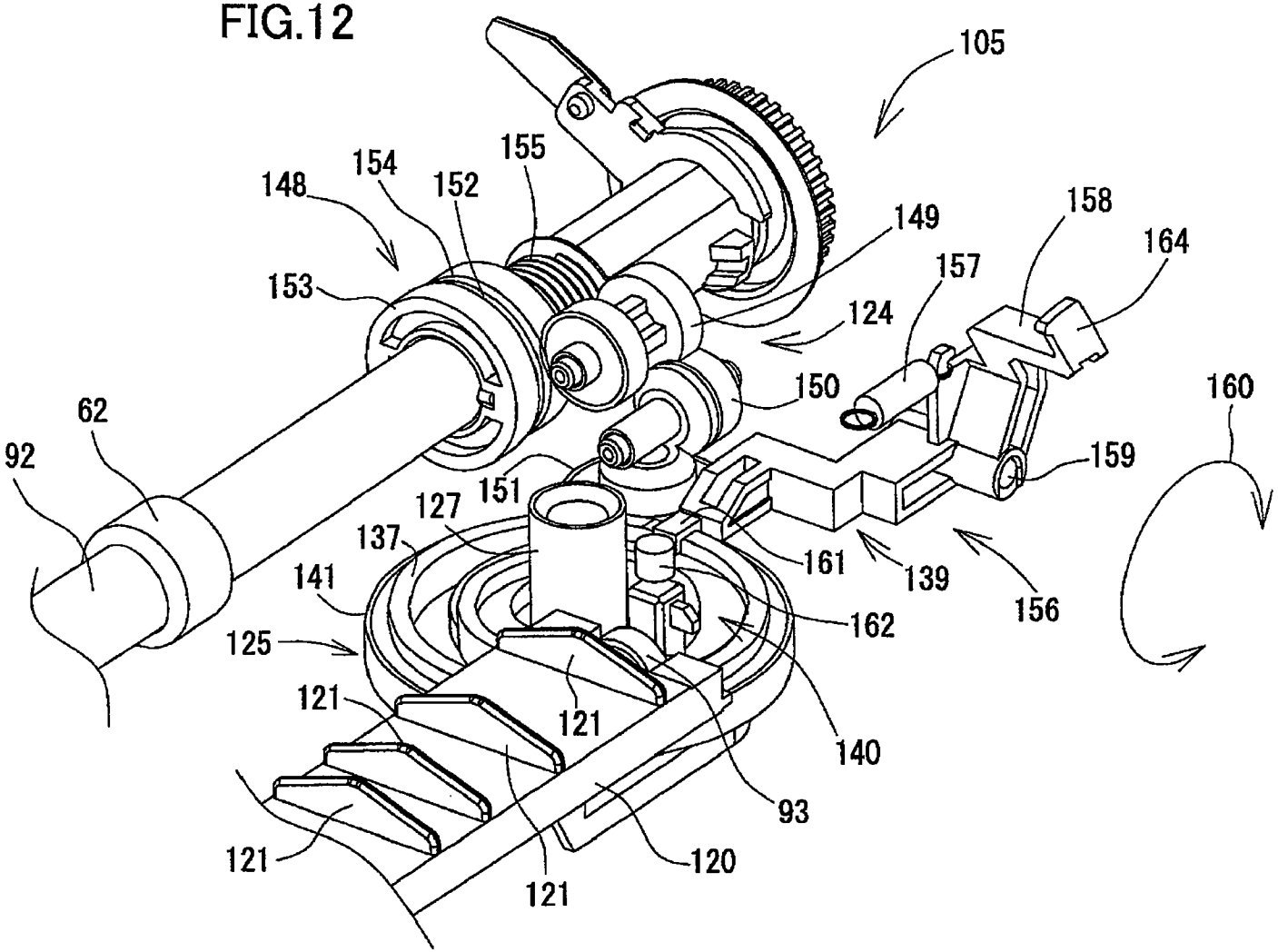
FIG. 12 is an enlarged perspective view of an interlock mechanism in the multifunction device of the first embodiment.

FIG. 10 is an enlarged perspective view of the movable support piece 88. FIG. 11 is an enlarged perspective view of the movable support piece 88 viewed from the bottom of the platen 42. FIG. 12 is an enlarged perspective view of the interlock mechanism 105.

As shown in FIGS. 10 and 11, the movable support piece 88 has a base 120 formed in a box shape, and ribs 121 provided on the base 120. The ribs 121 are formed in a thin plate shape and protrude from the platen 42 (see FIG. 9) The movable support piece 88 is configured of a synthetic resin or metal. The base 120 has an overall thin plate shape, but is substantially shaped as the letter C in cross section. As shown in FIG. 9, the base 120 is fitted inside the frame 100 from the bottom thereof. As shown in FIG. 10, a slide roller 93 is rotatably provided on each end of the base 120 in the main scanning direction. The slide roller 93 rotates smoothly relative to the frame 100. Hence, the base 120 can slide smoothly inside the frame 100 in the paper-conveying direction (the direction indicated by the arrow 89 in FIGS. 9 and 10).

The ribs 121 are provided on the top surface of the base 120 and are formed integrally with the base 120 Each of the ribs 121 is formed in a triangular shape. In the preferred embodiment, the ribs 121 are erected on the top surface of the base 120 and are juxtaposed at prescribed intervals in the main scanning direction (the direction indicated by the arrow 87 in FIG. 10). The prescribed intervals correspond to the pitch of the slits 119 (see FIG. 9). Hence, the ribs 121 are inserted through the multifunction device 119 provided in the frame 100 and protrude upward from the top surface 109 of the frame 100.

The ribs 121 constituting the movable support piece 88 are formed in a triangular shape, as described above. More specifically, a beveling process similar to that performed on the first fixed ribs 102 and second fixed ribs 103 is performed on corners 122 and 123 of the ribs 121, configuring sloped surfaces that slope relative to the paper-conveying direction. In the preferred embodiment, the sloped surfaces are formed on both of the corners 122 and 123 of the ribs 121 in the paper-conveying direction. However, it is possible to form the sloped surface on only the upstream corner 122.

As described above, the interlock mechanism 105 slides the movable support piece 88 in the paper-conveying direction. The interlock mechanism 105 is interposed between a discharge roller shaft 92 and the movable support piece 88 for interlocking the movable support piece 88 with the discharge roller shaft 92. The movable support piece 88 moves along with the movement of the recording paper as the recording paper is conveyed over the platen 42 so as to support the edges of the recording paper at all times. Specifically, when the recording paper has been conveyed to an upstream edge 94 of the frame 100 in the paper-conveying direction (see FIG. 9), the ribs 121 are moved to meet the recording paper and subsequently slide downstream in the paper-conveying direction as the recording paper is conveyed while supporting the edge of the recording paper.

As shown in FIG. 12, the interlock mechanism 105 includes the rotating plate 125 driven to rotate by a drive force transmitted from the discharge roller shaft 92 via a drive transmitting mechanism 124; and a lever member 126 disposed between the rotating plate 125 and the movable support piece 88 for converting the rotational movement of the rotating plate 125 to translational movement of the movable support piece 88.

Figure 13:
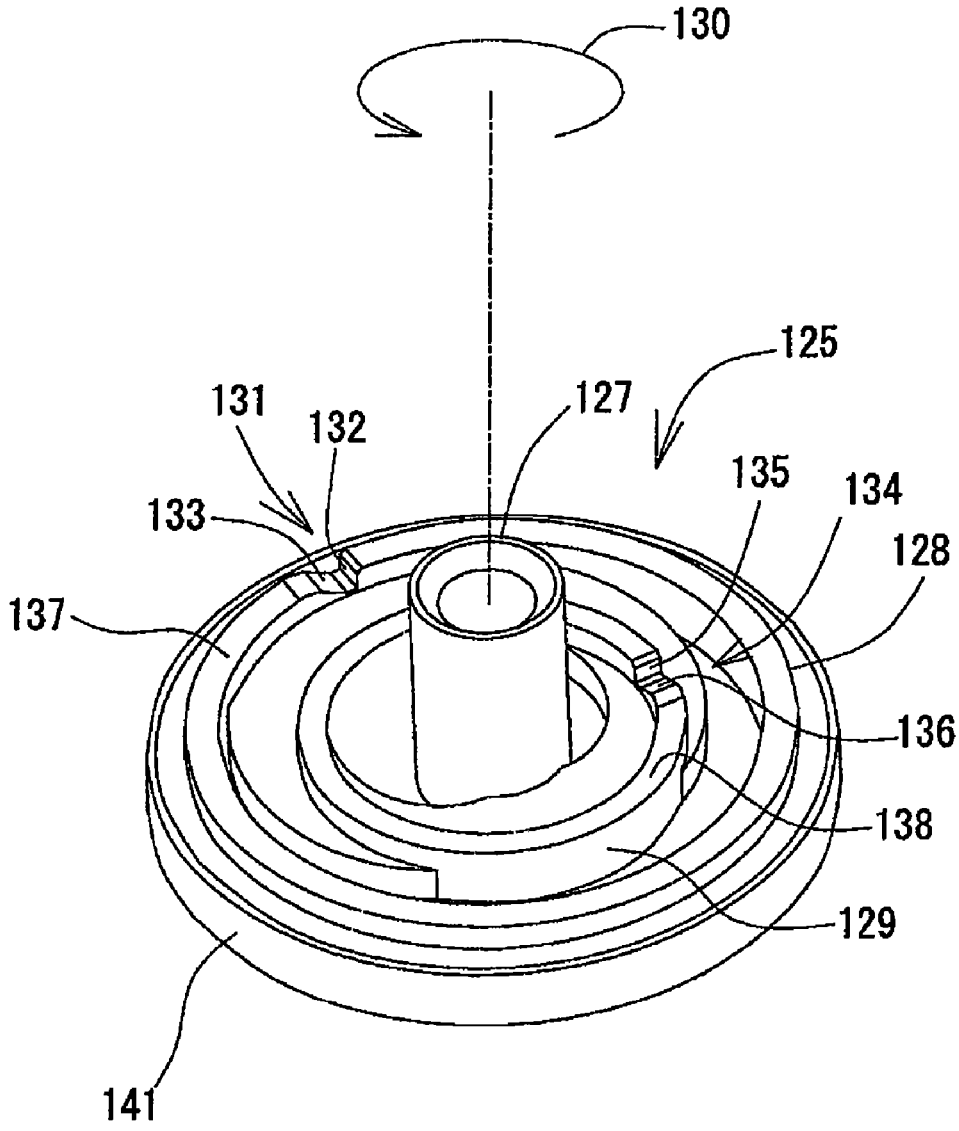
FIG. 13 is an enlarged perspective view of a rotating plate in the multifunction device of the first embodiment.
Figure 14:
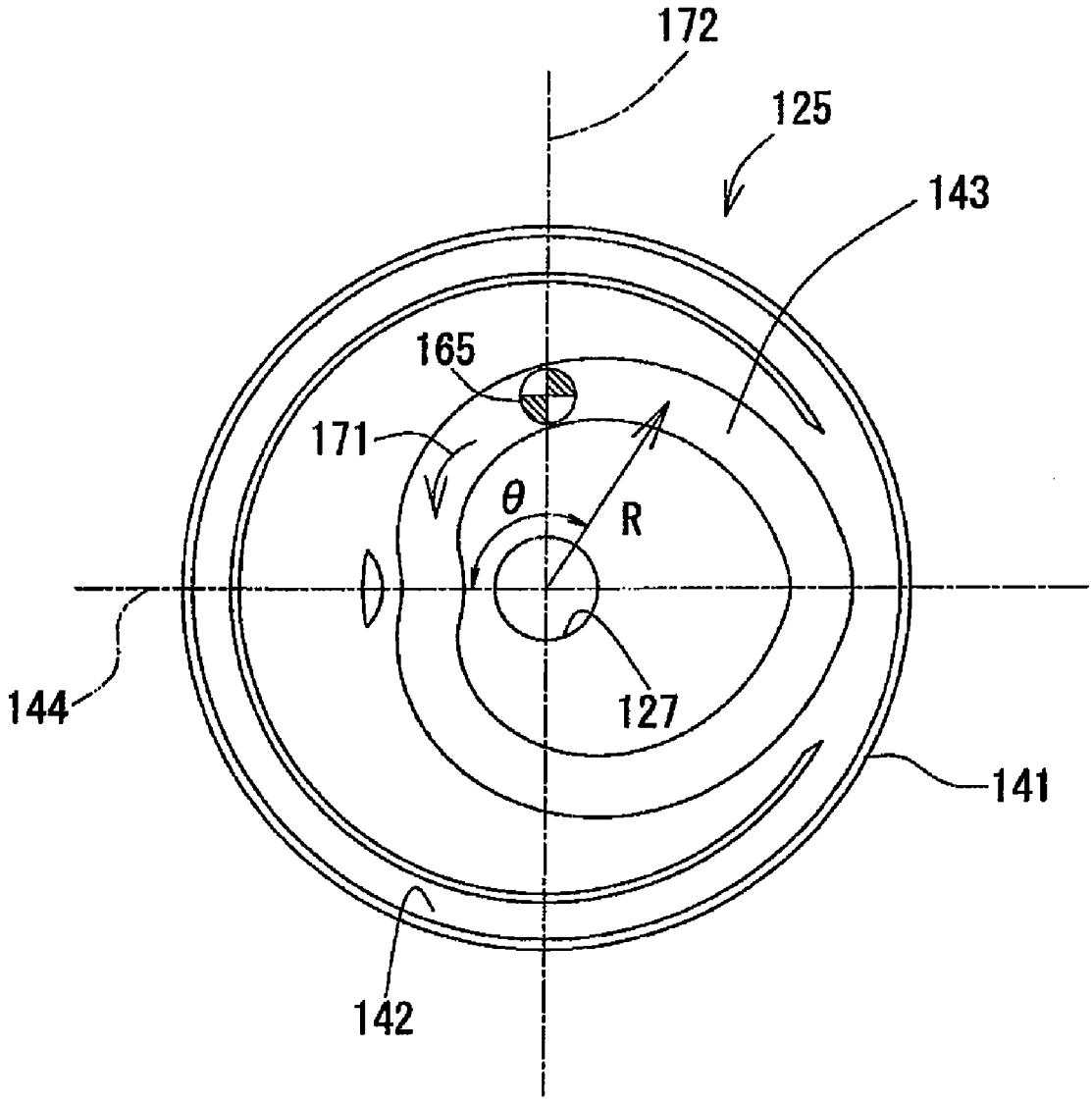
FIG. 14 is a bottom view of the rotating plate in the multifunction device of the first embodiment.

FIG. 13 is an enlarged perspective view of the rotating plate 125. FIG. 14 is a bottom view of the rotating plate 125.

As shown in FIGS. 12 and 1.3, the rotating plate 125 is disc-shaped and formed of synthetic resin or metal. The rotating plate 125 includes a circular rotating plate part 141, and a cylindrical shaft 127 erected from a center region in the top surface of the rotating plate part 141. The cylindrical shaft 127 is rotatably supported on the frame 100 of the platen 42. As one example, a center rotational shaft (not shown) may be erected in the frame 100. In this case, the center rotational shaft extends in a direction orthogonal to both the main scanning direction and the paper-conveying direction. The cylindrical shaft 127 is then fitted into the center rotational shaft so as to be capable of rotating freely. Alternatively, the center rotational shaft of the rotating plate 125 may be configured by fitting the cylindrical shaft 127 into the frame 100 directly. In addition, ribs 128 and 129 are erected from the top surface of the rotating plate 125. The rib 129 is formed with a rectangular cross-section and has an overall circular shape centered on the cylindrical shaft 127. The rib 128 also has a rectangular cross-section and an overall circular shape centered on the cylindrical shaft 127 and surrounding the rib 129.

The rotating plate 125 is driven in a forward rotation or a reverse rotation through the drive transmitting mechanism 124 described later, where the forward rotation is the direction indicated by the arrow 130. As shown in FIG. 13, a V groove 131 is provided in the rib 128. The V groove 131 forms two wall surfaces. One of the wall surfaces is a forward restricting surface 132 extending in the axial direction of the cylindrical shaft 127, that is, a direction orthogonal to the rotating direction of the rotating plate 125. The other wall surface is a reverse allowing surface 133 extending from the lower edge of the forward restricting surface 132 to the forward rotating side of the rib 128 in the peripheral direction and linking with a top surface 137 of the rib 128. In addition, a V groove 134 is formed in the rib 129, producing two wall surfaces therein. One of the wall surfaces is a reverse restricting surface 135 extending in the axial direction of the cylindrical shaft 127, that is, in a direction orthogonal to the rotating direction of the rotating plate 125. The other wall surface is a forward allowing surface 136 extending from the lower edge of the reverse restricting surface 135 to the reverse rotating side of the rib 129 in the peripheral direction thereof and linking to a top surface 138 of the rib 129. As will be described in greater detail below, a locking member 139 and a locking member 140 engage in the V groove 131 and V groove 134, respectively, for restricting or allowing the forward rotation and reverse rotation of the rotating plate 125.

As shown in FIGS. 11 and 14, a guide groove 143 is provided in a back surface 142 of the rotating plate 125. The guide groove 143 describes a prescribed curved path. More specifically, if a polar coordinate system is set in FIG. 4 with the center of the cylindrical shaft 127 set as the point of origin and a hypothetical axis 144 extending horizontally along the back surface 142, then the guide groove 143 follows a curved path that satisfies $R=k\theta$ (where k is a constant). In this case, an angle of $\theta=0$ indicates an angle from the point of origin along the left side of the hypothetical axis 144, and a positive $\theta$ indicates an angle in the clockwise direction. More specifically, the curved path depicts an Archimedean spiral, where the distance R from the point of origin to the center of the guide groove 143 has a linear relationship with the angle 0 However, in the preferred embodiment, the curved path conforming to $R=k\theta$ falls within the range $0°<=\theta<=180°$. The curved path formed within this range is symmetrical left-to-right (top-to-bottom in the drawing) about the hypothetical axis 144. Hence, the guide groove 143 is formed along the Archimedean spiral, which is vertically symmetrical about the hypothetical axis 144.

As shown in FIG. 11, the lever member 126 has a slender rod shape and is mounted on the base 120 of the movable support piece 88. Hence, in the preferred embodiment, the lever member 126 functions as a component of the interlock mechanism 105 and an engaging part for engaging the movable support piece 88 to the rotating plate 125. More specifically, a distal end 145 of the lever member 126 engages with the bottom surface of the base 120, while a base end 146 of the lever member 126 engages with the guide groove 143 in the rotating plate 125. The lever member 126 has a center part 147 supported on the frame 100 of the platen 42. FIG. 11 does not show the support structures for the lever member 126 and the frame 100 of the platen 42. However, this structure may include a support shaft (not shown) provided on the frame 100 in which the center part 147 is rotatably fitted.

By fitting the base end 146 of the lever member 126 into the guide groove 143 of the rotating plate 125, the base end 146 can only be displaced in the paper-conveying direction. However, the distal end 145 of the lever member 126 is fitted into the base 120 and can therefore only be displaced in the paper-conveying direction. Hence, by rotating the rotating plate 125, the base end 146 of the lever member 126 is guided along the guide groove 143, while the lever member 126 pivots about the center part 147. As a result, the distal end 145 of the lever member 126 pivots about the center part 147. Since the distal end 145 can be displaced in the paper-conveying direction, the base 120 slides in the paper-conveying direction as the distal end 145 pivots.

Here, the displacement of the distal end 145 is a prescribed multiple of the displacement in the base end 146. This multiple more specifically corresponds to the ratio of the distance from the center part 147 to the distal end 145 and the distance from the center part 147 to the base end 146. Therefore, the displacement of the distal end 145 amplifies the displacement in the base end 146 by the prescribed multiple. In other words, the lever member 126 converts the rotation of the rotating plate 125 to displacement of the base 120 in the paper-conveying direction according to the prescribed ratio.

As shown in FIG. 12, the drive transmitting mechanism 124 includes a torque limiter 148 provided on the discharge roller shaft 92, and gears 149-151. The torque limiter 148 includes a flange 153 provided on the discharge roller shaft 92, a pressure plate 154 contacting the flange 153 via a friction plate 152 such as non-woven fabric, and a coil spring 155 that elastically urges the pressure plate 154 along with the friction plate 152 toward the flange 153. When the coil spring 155 presses the pressure plate 154 into the flange 153, a prescribed frictional force is generated therebetween for transmitting a drive force. More specifically, the torque transmitted between the pressure plate 154 and flange 153 is limited. This limited torque can be increased by increasing the elastic force of the coil spring 155.

While not illustrated in FIG. 12, teeth are formed around the outer peripheral surface of the pressure plate 154 for engaging with the gear 149. Hence, the gear 149 rotates together with the rotating pressure plate 154. The gear 150 is engaged with the gear 149, and the gear 151 is engaged with the gear 150. However, the gear 150 and gear 151 are configured of bevel gears with orthogonal axes oriented orthogonal to each other. As shown in FIG. 11, the outer peripheral surface of the gear 151 contacts the outer peripheral surface of the rotating plate 125. In the preferred embodiment, a frictional force is generated through contact between the gear 151 and rotating plate 125 for transmitting torque therebetween. However, it should be apparent that both the gear 151 and rotating plate 125 may be provided with teeth and interlocked to form a gear train.

In the preferred embodiment, a rotation restricting device 156 is provided for restricting rotation of the rotating plate 125. As shown in FIG. 12, the rotation restricting device 156 includes the locking member 139 and locking member 140, a coil spring 157 for elastically urging the locking member 139 to engage with the rotating plate 125, and a contact member 158 for changing the orientation of the locking member 140, as will be described later, when contacted by the inkjet recording head 39 sliding in the main scanning direction.

The locking member 139 is formed in the shape of a crankshaft. A base end of the locking member 139 is rotatably supported on a support shaft 159. Accordingly, the locking member 139 can rotate about the support shaft 159 in an elevating direction indicated by the arrow 160. An engaging pawl 161 is provided on the distal end of the locking member 139. The engaging pawl 161 is formed in a wedge shape for fitting into the V groove 131 of the rotating plate 125.

Since the locking member 139 can pivot about the support shaft 159, the orientation of the locking member 139 can be changed between a rotation restricting orientation laying down on the rotating plate 125 side with the engaging pawl 161 fitted into the V groove 131, and a rotation allowing orientation angled upward above the rotating plate 125 with the engaging pawl 161 removed from the V groove 131. However, the coil spring 157 is provided for constantly urging the locking member 139 into the rotation restricting orientation.

Therefore, when the engaging pawl 161 is fitted into the V groove 131, the forward restricting surface 132 (see FIG. 13) contacts the engaging pawl 161 when the rotating plate 125 rotates in the forward direction. Therefore the rotating plate 125 is restricted from rotating forward at this time. However, if the rotating plate 125 rotates in reverse while the engaging pawl 161 is fitted into the V groove 131, the engaging pawl 161 can slide over the reverse allowing surface 133 (see FIG. 13). When the engaging pawl 161 slides over the reverse allowing surface 133, the locking member 139 shifts into the rotation allowing orientation against the urging force of the coil spring 155. At this time, the engaging pawl 161 reaches the top surface 137 of the rib 128 and slides over the top surface 137 as the rotating plate 125 rotates.

The locking member 140 is formed in the shape of a quadratic prism. While not shown in FIG. 12, an engaging pawl is formed on the lower end of the locking member 140. This pawl is wedge-shaped similar to the engaging pawl 161 of the locking member 139 so as to fit into the V groove 134 provided in the rib 129. The locking member 140 is also capable of sliding up and down in FIG. 2, but a coil spring 162 constantly urges the locking member 140 downward. The engaging pawl provided on the locking member 140 constantly engages with the rotating plate 125 to restrict reverse rotation of the same, but allows forward rotation of the rotating plate 125.

The contact member 158 is coupled to the base end of the locking member 139. Accordingly, the contact member 158 can rotate about the support shaft 159 together with the locking member 139. A distal end 164 of the contact member 158 extends upward so that the carriage 38 supporting the inkjet recording head 39 (see FIG. 5) comes into contact with the distal end 164 when sliding in the main scanning direction. Further, the coil spring 157 is coupled to the contact member 158 for elastically urging the contact member 158 together with the locking member 139, as described above.

Next, an overview of the image-recording operation performed with the multifunction device 1 according to the preferred embodiment will be described.

In the multifunction device 1 according to the preferred embodiment, the user operates the control panel 4 (see FIG. 1) to select an image-recording format. More specifically, by operating the control panel 4, the user can select border recording or borderless recording. After the user sets the format through the control panel 4, the ASIC 70 (see FIG. 8) transmits a signal to the CPU 65 specifying a recording format. Upon receiving this signal, the CPU 65 issues a command to the drive circuit 74 and drive circuit 75 for driving the carriage motor 73 and inkjet recording head 39. Specifically, when the format is set to borderless recording, the carriage motor 73 is driven so that the carriage 38 (see FIG. 5) is pressed against the contact member 158.

Figure 15:
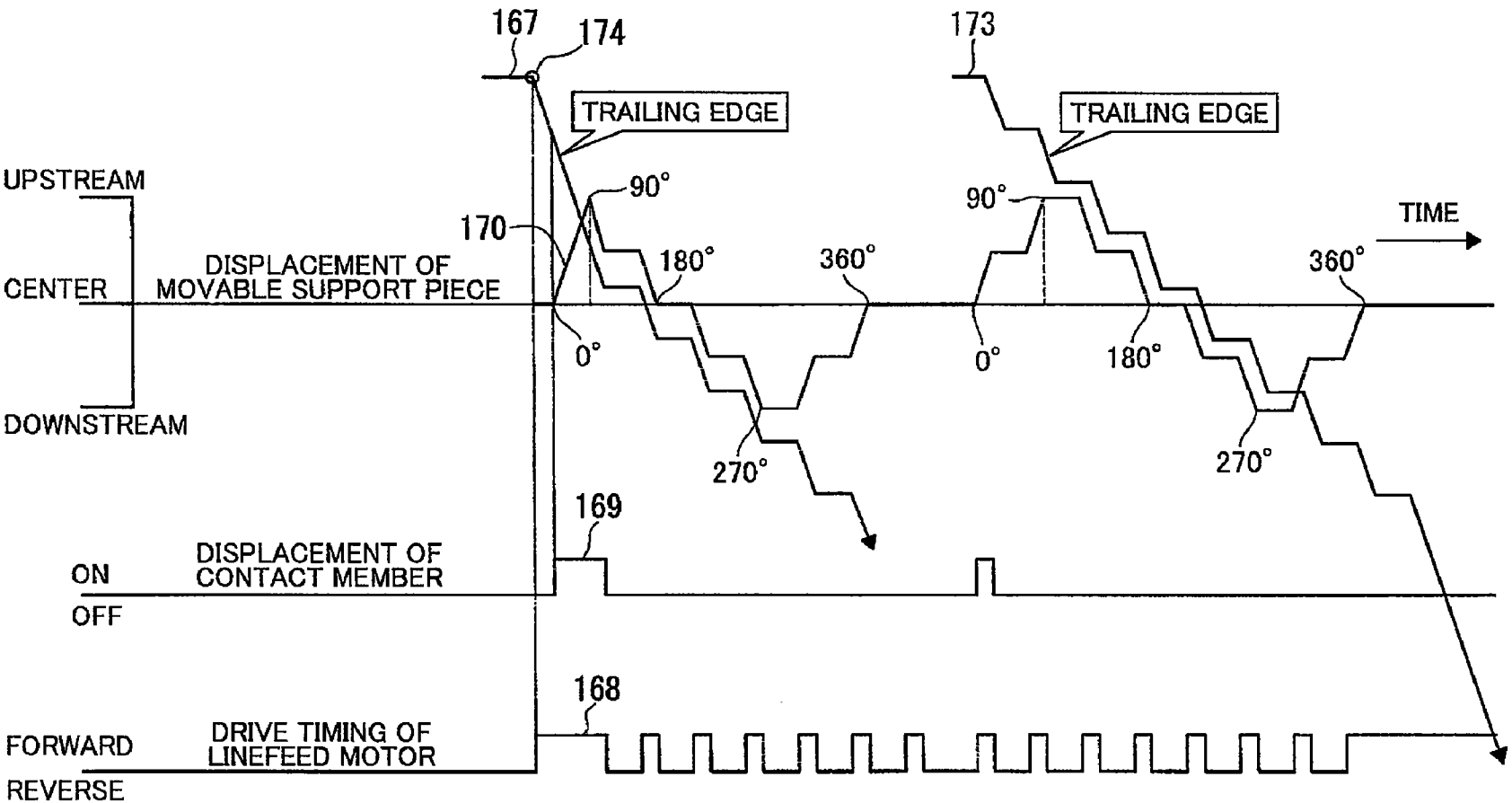
FIG. 15 is a timing chart showing the timing for conveying recording paper and sliding the movable support piece during borderless recording.

FIG. 15 is a timing chart showing a timing for conveying recording paper and sliding the movable support piece 88 when performing borderless recording. The horizontal axis in FIG. 15 represents the passage of time. Lines 167 and 173 in FIG. 15 indicate the positions of the leading edge and trailing edge, respectively, of the conveyed recording paper, while a line 170 indicates displacement of the movable support piece 88. Lines 169 and 168 indicate displacement of the contact member 158 and the drive timing of the linefeed motor 71, respectively. FIGS. 16A-16D show the sequential displacement of the movable support piece 88 when the recording paper is conveyed. An arrow 166 in FIG. 16 indicates the paper-conveying direction. Operations shown in FIG. 16 occur from the moment that the recording paper has been registered by the conveying roller 60 until the recording operation is completed. The operations for conveying the recording paper from the feeding tray 20 to the conveying roller 60 have been omitted.

In order to feed recording paper accommodated in the feeding tray 20 to the paper-conveying path 23 for image recording, the controller 64 drives the linefeed motor 71 to rotate the feeding roller 25. During this feeding operation, the linefeed motor 71 is driven in a reverse rotation. The transmitted drive force from the linefeed motor 71 rotates the feeding roller 25 in a direction for feeding the recording paper, while rotating the conveying roller 60 and discharge rollers 62 in a direction opposite the paper-conveying direction. As the recording paper fed from the feeding tray 20 is conveyed along the paper-conveying path 23, the recording paper is inverted vertically by the U-shaped paper-conveying path 23. The leading edge of the recording paper contacts the registration sensor 95 and subsequently contacts the conveying roller 60 and pinch roller. Since the conveying roller 60 is rotating in a direction opposite the paper-conveying direction, the recording paper is registered while the leading edge is in contact with the conveying roller 60 and the pinch roller A point 174 in FIG. 15 indicates the registration position of the recording paper. After the registration process is completed, the controller 64 drives the linefeed motor 71 to move in a forward rotation. Consequently, the conveying roller 60 and the pinch roller pinch the registered recording paper and convey the paper over the platen 42 as indicated by the line 167.

As the discharge rollers 62 are driven to rotate in the direction opposite the paper-conveying direction by the reverse rotation of the linefeed motor 71, this rotation is transmitted to the rotating plate 125 via the drive transmitting mechanism 124. However, rotation of the rotating plate 125 is restricted when the rotating plate 125 is in the initial position, that is, when the locking member 140 is engaged in the V groove 134. Hence, only the rotating support member 90 is allowed to rotate in reverse by the torque limiter 148 as the reverse rotation of the rotating plate 125 is halted. However, if the rotating plate 125 is not in the initial position and, hence, the locking member 140 is not engaged with the V groove 134, then the rotation of the discharge rollers 62 is transmitted to the rotating plate 125 via the drive transmitting mechanism 124, causing the rotating plate 125 to rotate in reverse. Subsequently, the rotating plate 125 rotates in reverse until reaching the initial position, at which time the locking member 140 engages with the V groove 134 and restricts further rotation of the rotating plate 125 in reverse so that only the discharge roller shaft 92 is rotating in reverse. This operation for driving the linefeed motor 71 in reverse is performed to move the rotating plate 125 to the initial position and may be performed when the power to the multifunction device 1 is turned on or after an error is resolved. Further, by moving the rotating plate 125 to the initial position, the locking member 139 engages with the V groove 131 to restrict forward rotation of the rotating plate 125.

Figure 16A:
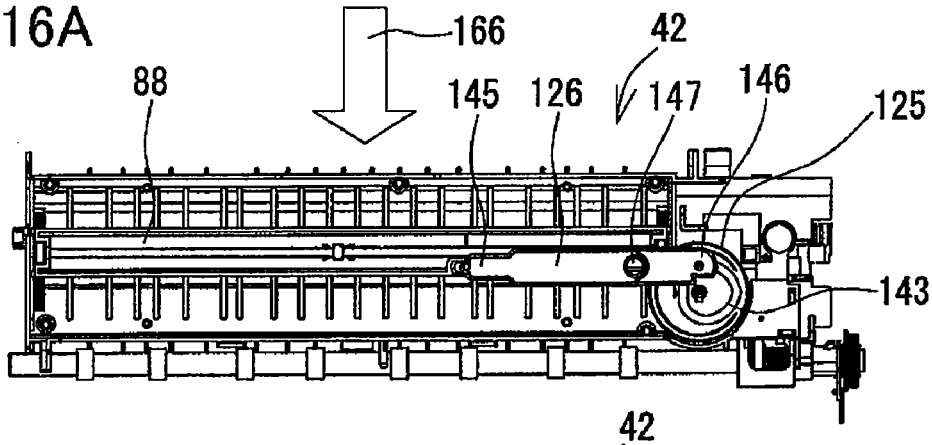
FIGS. 16A-16D are explanatory diagrams showing the sequence of displacement in the movable support piece when conveying recording paper.

During borderless recording, the movable support piece 88 slides along with the conveyance of the recording paper. More specifically, when the recording paper is set in the initial position 174 (see FIG. 15), the movable support piece 88 is positioned in the center of the platen 42, as shown in FIG. 16A At this time, the base end 146 of the lever member 126 is at a prescribed position in the guide groove 143 of the rotating plate 125, indicated by reference numeral 165 in FIG. 14. Reference numeral 165 indicates a position in which a hypothetical axis 172 passing through the center of the cylindrical shaft 127 orthogonal to the hypothetical axis 144 intersects the guide groove 143. The movable support piece 88, rotating plate 125, and lever member 126 are at initial positions relative to each other in FIG. 16A.

After the leading edge of the recording paper is registered by the conveying roller 60, as described above, the linefeed motor 71 is driven intermittently in a forward rotation for conveying the recording paper to recording positions over the platen 42, as indicated by the line 168 in FIG. 15. Subsequently, the carriage motor 73 is driven at a prescribed timing indicated by the line 169. The driven carriage motor 73 slides the carriage 38 in the main scanning direction until the carriage 38 contacts the contact member 158 of the rotation restricting device 156. At this time, the controller 64 regulates the sliding amount of the carriage 38 by controlling the driving of the carriage motor 73.

As shown in FIG. 12, when the carriage 38 presses against the contact member 158 in the main scanning direction (ON in FIG. 15), the locking member 139 rotates about the support shaft 159 to the rotation allowing orientation. Therefore, the engaging pawl 161 is disengaged from the rotating plate 125, enabling the rotating plate 125 to rotate forward (clockwise about the cylindrical shaft 127). As described above, when the linefeed motor 71 rotates the discharge roller shaft 92 in the paper-conveying direction, this rotation is transmitted to the rotating plate 125 via the drive transmitting mechanism 124, driving the rotating plate 125 in a forward rotation. As a result, the movable support piece 88 is displaced, as indicated by the line 170 in FIG. 15, and the relative positions of the movable support piece 88, rotating plate 125, and lever member 126 change in the sequence shown in FIG. 16B-16D. Next, the movement of the movable support piece 88 will be described in greater detail.

Figure 16B:
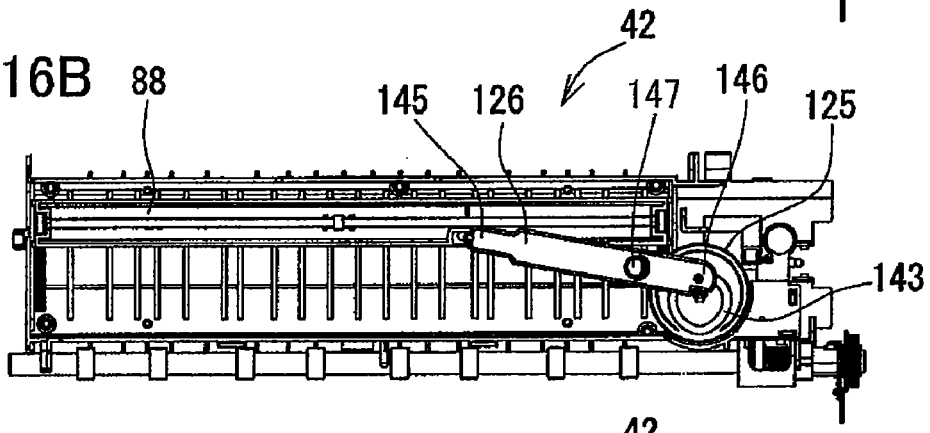

Initially, the movable support piece 88 is positioned at an intermediate between the first fixed ribs 102 and the second fixed ribs 103 (see FIG. 9). However, when the leading edge of the recording paper is conveyed to the upstream end of the frame 100, the movable support piece 88 moves to the upstream side in the paper-conveying direction to meet the recording paper, as indicated by the line 170 in FIG. 15. Specifically, the linefeed motor 71 rotates forward, causing the conveying roller 60 to rotate in the conveying direction and convey the recording paper to the platen 42. At the same time, the forward rotation of the linefeed motor 71 is transferred to the rotating plate 125, driving the rotating plate 125 to rotate forward. At this time, the rotating plate 125 rotates in the clockwise direction of FIGS. 14 and 16. When the rotating plate 125 rotates forward, the position 165 of the base end 146 of the lever member 126 moves relative to the rotating plate 125 in the direction indicated by the arrow 171 in FIG. 14. Hence, the distance between the position 165 of the base end 146 and the cylindrical shaft 127 gradually grows smaller as the rotating plate 125 rotates. Consequently, the lever member 126 pivots about the center part 147, moving the movable support piece 88 upstream in the conveying direction, as shown in FIG. 16B. When the rotated angle of the rotating plate 125 reaches 90°, the movable support piece 88 is in a first position between neighboring first fixed ribs 102 for meeting the recording paper. In the preferred embodiment, the movable support piece 88 moves to the first position corresponding to the upstream end in the paper-conveying direction before the leading edge of the recording paper arrives at the upstream end of the platen 42, as shown in FIG. 15. Accordingly, the recording paper covers the top of the ribs 121 on the movable support piece 88.

Figure 16C:
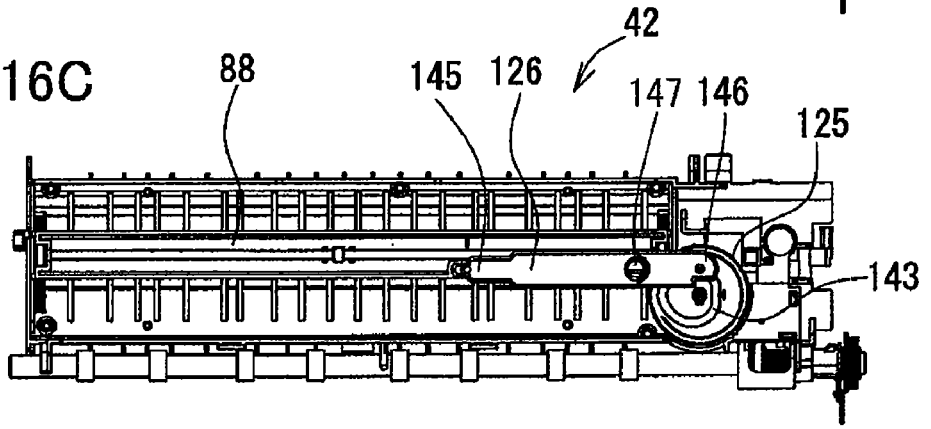
Figure 16D:
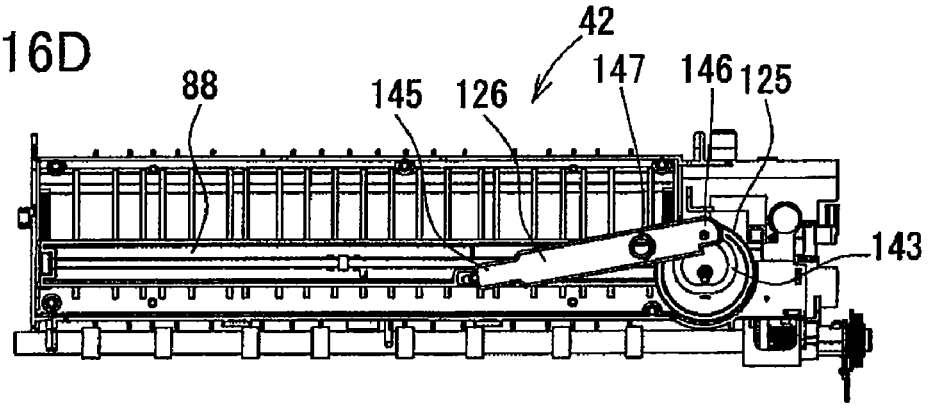

Subsequently, image recording is performed on the recording paper by repeatedly and alternately ejecting ink droplets from the inkjet recording head 39 while the carriage 38 reciprocates, and conveying the recording paper a prescribed linefeed corresponding to the set resolution. Specifically, the linefeed motor 71 is driven intermittently in a forward rotation, as indicated by the line 168 in FIG. 15, thereby intermittently conveying the recording paper by the prescribed linefeed widths. Since the rotating plate 125 rotates in association with the driving of the linefeed motor 71, the rotating plate 125 rotates intermittently by prescribed angles of rotation in synchronization with the intermittent conveying of the recording paper. The position 165 for the base end 146 of the lever member 126 shifts farther in the direction of the arrow 171 in FIG. 14 and returns to the initial position when the rotating plate 125 reaches a rotational angle of 360°. Hence, when the rotating plate 125 is at a rotational angle exceeding 90° and no greater than 270°, the distance between the position 165 of the base end 146 and the cylindrical shaft 127 gradually increases as the rotating plate 125 rotates. Hence, as shown in FIG. 16B-16D, the lever member 126 pivots about the center part 147, moving the movable support piece 88 downstream in the paper-conveying direction. When the rotational angle of the rotating plate 125 reaches 270°, the movable support piece 88 is in the second position between neighboring second fixed ribs 103. Hereafter, the distance between the position 165 of the base end 146 and the cylindrical shaft 127 gradually decreases as the rotating plate 125 rotates further. Accordingly, the lever member 126 pivots about the center part 147, moving the movable support piece 88 toward the upstream side in the paper-conveying direction. When the rotational angle of the rotating plate 125 reaches 360°, the movable support piece 88 has returned to the initial position.

When the rotating plate 125 rotates as described above, the engaging pawl 161 slides over the top surface 137 of the rib 128, as shown in FIG. 12. Therefore, when the rotational angle of the rotating plate 125 reaches 360°, the engaging pawl 161 is again fitted into the V groove 131 of the rotating plate 125 (see FIG. 13) due to the urging force of the coil spring 157, thereby restricting forward rotation of the rotating plate 125. While the drive transmitting mechanism 124 is halted when forward rotation of the rotating plate 125 is restricted, the torque limiter 148 allows the driving force from the linefeed motor 71 to be transmitted to the conveying roller 60 and the discharge roller shaft 92 so that smooth conveyance of the recording paper is maintained.

In this state, the recording paper is conveyed intermittently as prescribed linefeed widths, while recording continues, as shown in FIG. 15. Specifically, initially, the movable support piece 88 is halted in the initial position, as indicated by the line 170 in FIG. 15, while the trailing edge of the recording paper approaches the upstream end of the platen 42, as indicated by the line 173. When the registration sensor 95 detects the trailing edge of the recording paper, the controller 64 controls the driving of the carriage motor 73 based on detection signals from the registration sensor 95 in order that the carriage 38 slides in the main scanning direction and contacts the contact member 158 (ON in FIG. 15), as indicated by the line 169 in FIG. 15.

When the carriage 38 presses against the contact member 158 in the main scanning direction, the locking member 139 rotates about the support shaft 159 and disengages the engaging pawl 161 from the rotating plate 125, as described above. Therefore, the rotating plate 125 can move in a forward rotation (clockwise about the cylindrical shaft 127). As a result, the movable support piece 88 is displaced as indicated by the line 170 in FIG. 15, changing the relative positions of the movable support piece 88, rotating plate 125, and lever member 126 in the sequence shown in FIGS. 16B-16D. In other words, the movable support piece 88 moves intermittently to the first position corresponding to the upstream end in the paper-conveying direction by the intermittent driving of the linefeed motor 71 before the trailing edge of the recording paper arrives at the upstream end of the platen 42. Here, the ribs 121 of the movable support piece 88 are still covered by the recording paper. Subsequently, the image-recording operation is continued by repeatedly and alternately ejecting ink droplets from the inkjet recording head 39 as the carriage 38 reciprocates, and conveying the recording paper by prescribed linefeed widths corresponding to the set resolution. Since the rotating plate 125 rotates in association with the driving of the linefeed motor 71, the intermittent driving of the linefeed motor 71 described above causes the rotating plate 125 to rotate intermittently at prescribed angles of rotation in synchronization with the linefeed motor 71. Accordingly, the rib 121 slides downstream in the paper-conveying direction while supporting the recording paper.

After the rotating plate 125 completes one rotation, the engaging pawl 161 is again fitted into the V groove 131 of the rotating plate 125 by the urging force of the coil spring 157, thereby restricting forward rotation of the rotating plate 125 and returning the movable support piece 88, rotating plate 125, and lever member 126 to their initial positions. Once the image-recording operation is completed, the linefeed motor 71 is driven continuously in the forward rotation for discharging the recording paper onto the discharge tray 21. While the rotation of the rotating plate 125 is restricted at this time, the torque limiter 148 allows the discharge rollers 62 to rotate smoothly.

However, if the user sets the image-forming format to border recording by operating the control panel 4, the carriage 38 is not moved into contact with the contact member 158 Therefore, the movable support piece 88 does not slide as described above, but remains halted in the initial position. When performing border recording, it is still preferable to rotate the linefeed motor 71 in reverse prior to feeding the recording paper In this case, even if the locking member 140 is not engaged with the rotating plate 125, the rotating plate 125 rotates in reverse as described above until the locking member 140 is fitted into the V groove 134 of the rotating plate 125, thereby reliably initializing the locking member 140 of the rotating plate 125.

In the multifunction device 1 according to the preferred embodiment, the platen 42 supports the recording paper as the recording paper is conveyed over the platen 42, and the inkjet recording head 39 records an image on the recording paper by ejecting ink droplets as the carriage 38 slides in the main scanning direction. The recording paper is conveyed in the paper-conveying direction during the image-recording operation, while the movable support piece 88 slides in the paper-conveying direction while supporting the recording paper, as shown in FIGS. 9 and 15.

As shown in FIG. 12, the movable support piece 88 is driven by the rotation of the rotating plate 125. However, the rotating plate 125 rotates about the cylindrical shaft 127, and the cylindrical shaft 127 is orthogonal to the top surface 109 of the platen 42. In other words, the rotating plate 125 rotates in a position parallel to the top surface 109 of the platen 42. Therefore, the rotating plate 125 is disposed efficiently and compactly near the platen 42, achieving a compact image-recording unit 24 and facilitating a compact design for the multifunction device 1.

Since the lever member 126 is engaged in the guide groove 143 of the rotating plate 125, as shown in FIG. 16, rotation of the rotating plate 125 moves the distal end 145 of the lever member 126 in the paper-conveying direction between the upstream end and the downstream end of the platen 42. Hence, the movable support piece 88 slides smoothly together with the recording paper as the recording paper is conveyed so as to constantly support the edge of the recording paper and to prevent the recording paper from bending in the paper-conveying direction. This construction prevents the recording paper from dropping into the groove 116 formed between the first fixed ribs 102 and second fixed ribs 103 in the preferred embodiment. Accordingly, a fixed distance is maintained between the recording paper and the inkjet recording head 39 so that high quality images can be recorded on the paper.

Moreover, since the movable support piece 88 is driven by the linefeed motor 71, the movable support piece 88 can slide more smoothly. Accordingly, images of higher quality can be recorded on the paper.

In the preferred embodiment, the movable support piece 88 moves in association with the discharge roller shaft 92, which is driven by the linefeed motor 71. In most inkjet recording devices, the conveying roller 60 is disposed near the inkjet recording head 39, and the drive transmitting mechanism 83 for transmitting a driving force from the conveying roller 60 to the discharge rollers 62, the purge mechanism 51, and the like must maintain a prescribed geometrical relationship with the conveying roller 60 and inkjet recording head 39. Hence, if the movable support piece 88 were to receive a driving force from the conveying roller 60 disposed near the inkjet recording head 39, the image-recording unit 24 would require a complex structure that would be difficult to design due to the geometrical relationship. However, in the multifunction device 1 according to the preferred embodiment, the movable support piece 88 obtains a drive force from the discharge rollers 62 disposed in a region of the multifunction device 1 having more available space, thereby simplifying the structure of the image-recording unit 24 and enabling a more compact design for the multifunction device 1.

By employing a disc-shaped rotating plate 125 as the means for driving the movable support piece 88 in the preferred embodiment, the structure for driving the movable support piece 88 is extremely simple, and the structure for rotating the rotating plate 125 can be achieved with a compact design. Accordingly, the image-recording unit 24 can be made even more compact.

Further, by forming the guide groove 143 in the rotating plate 125 in the shape described above, the movable support piece 88 initially slides upstream in the paper-conveying direction to meet the recording paper and subsequently slides downstream as the recording paper is conveyed, as shown in FIG. 16. In this way, the movable support piece 88 constantly supports the edge of the recording paper thereby reliably maintaining a fixed distance between the recording paper and the inkjet recording head 39. Accordingly, higher quality images can be recorded on the recording paper.

Particularly, since the guide groove 143 is shaped like an Archimedean spiral in the preferred embodiment, the distal end 145 of the lever member 126 moves radially from the center of the rotating plate 125 as the rotating plate 125 rotates (see FIG. 16). Specifically, the rotating angle of the rotating plate 125 has a linear relationship with the movement of the distal end 145, as described above. Therefore, the movable support piece 88 smoothly follows the conveyance of the recording paper at a constant speed in response to the rotating plate 125 rotating at a constant speed, that is, in synchronization with the recording paper that is conveyed intermittently at prescribed linefeed widths. Therefore, the conveying length (linefeed width) of the recording paper is set smaller when recording at a high resolution, for example. In response, the rotating plate 125 rotates intermittently at smaller angles of rotation. The linefeed width of the recording paper is set larger when recording at a low resolution. In response, the rotational angle of the rotating plate 125 is increased greatly to increase the movement of the movable support piece 88 so that the movable support piece 88 more reliably supports the recording paper and more reliably maintains the distance between the recording paper and the inkjet recording head 39.

If the guide groove 143 were not formed in an Archimedean spiral, the rotating plate 125 may rotate at a constant speed unrelated from the linefeed widths of the recording paper. While this configuration does not produce any complications immediately, the constant speed of the rotating plate 125 may cause the movable support piece 88 to pass the conveyed recording paper. If there is a danger of this happening, it is possible to halt the movable support piece 88 at a ratio of once for each prescribed number of linefeeds.

As shown in FIGS. 14 and 16, the guide groove 143 in the preferred embodiment is formed to follow an Archimedean spiral that is symmetrical about the hypothetical axis 144. Therefore, the movable support piece 88 can move in one continuous motion, first to slide from the initial position shown in FIG. 16A upstream to meet the recording paper, subsequently to slide downstream along with the conveyance of the recording paper while supporting the edge of the recording paper, and finally sliding upstream again to return to the initial position. Therefore, the movable support piece 88 is always reliably disposed in the initial position. In other words, it is not necessary to initialize the movable support piece 88 for each of recording paper when recording on a plurality of sheets continuously, thereby increasing the speed of continuous recording Accordingly, the movable support piece 88 can reliably support the edge of the recording paper and can reliably prevent the recording paper from entering the groove 116.

The multifunction device 1 according to the preferred embodiment also has the following operations and effects.

The edge of the recording paper conveyed over the first fixed rib 102 passes above the groove 116. At this time, the movable support piece 88 slides together with the recording paper as the recording paper is conveyed so as to support the edge of the recording paper at all times and prevent the edge from entering the groove 116. Accordingly, the movable support piece 88 can maintain a fixed distance between the recording paper and the inkjet recording head 39.

In the preferred embodiment, the recording paper conveyed over the platen 42 is first supported on the first fixed ribs 102, and subsequently supported on the second fixed ribs 103 after passing over the groove 116. When performing borderless recording in particular, the groove 116 can receive ink droplets ejected from the inkjet recording head 39 beyond the edge of the recording paper. The bottom of the groove 116 may be lined with an ink absorbing material such as a sheet-like sponge material capable of reliably absorbing ink droplets that reach the groove 116.

As described above, since the recording paper covers the movable support piece 88 when the movable support piece 88 is supporting the edge of the paper, ink droplets ejected onto the recording paper do not become deposited on the movable support piece 88. Hence, when recording on a plurality of sheets continuously, the bottom surface of subsequent sheets of recording paper do not become stained with ink deposited when recording on the preceding sheets.

Further, since the movable support piece 88 supports the recording paper, the groove 116 can be formed with a large width dimension 117, making it possible to increase the size of the inkjet recording head 39 because the groove 116 can cover the entire ink ejection range 118 of a large inkjet recording head 39. This construction makes it possible to perform borderless recording at a high speed.

The first fixed ribs 102, second fixed ribs 103, and ribs 121 functioning to support the recording paper are particularly advantageous because they provide an extremely simple structure for supporting the recording paper and they reduce the area of contact between the support members and the recording paper. Consequently, this construction reduces resistance to the recording paper, enabling the recording paper to be conveyed more smoothly.

In the preferred embodiment, the width dimension 117 of the groove 116 (see FIG. 9) is set wider than the ink ejection range 118 of the inkjet recording head 39 (see FIG. 6). With this construction, the groove 116 will receive all ink droplets ejected from the nozzles 53 of the inkjet recording head 39, even when recording paper is not present on the platen 42. Hence, when performing borderless recording, the inkjet recording head 39 can eject ink droplets from all nozzles 53 when recording on the edges of the recording paper. Hence, it is not necessary to perform a complex control process for ejecting ink droplets from the nozzles 53 when performing borderless recording, thereby increasing the speed of the recording operation.

Put another way, if the width dimension 117 of the groove 116 were narrower than the ink ejection range 118 of the inkjet recording head 39, then it would be necessary to eject ink droplets only from nozzles 53 on the upstream side of the inkjet recording head 39 when performing borderless recording on the leading edge portion of the recording paper, and subsequently to eject ink droplets from sequential rows of nozzles 53 on the downstream side as the recording paper is conveyed, thereby requiring a complex process for controlling the inkjet recording head 39. In contrast, the multifunction device 1 of the preferred embodiment can eliminate this complex control process. As described above, the multifunction device 1 can perform borderless recording on the edge of the recording paper by ejecting ink droplets from all nozzles 53. Hence, borderless recording can be performed at a high speed, without implementing a complex control process for ejecting ink droplets from the nozzles 53.

Further, the cross-sectional shape of the nozzles 53 is not always perfectly round and occasionally fine particles of foreign matter become deposited inside the nozzles 53. These factors sometimes contribute to an ink droplet trajectory that is less than straight from the nozzles 53. However, since the width dimension 117 of the groove 116 is set wider than the ink ejection range 118 of the inkjet recording head 39 in the preferred embodiment, the ink droplets do not land outside of the groove 116 even in this case. Hence, this construction reliably prevents ink from staining the underside of recording paper.

By using the first fixed ribs 102, second fixed ribs 103, and ribs 121 for supporting the recording paper, the structure of the components used to support the recording paper is very simple, and the surface area of contact between the ribs and the recording paper is small. Reducing the surface area of contact with the recording paper reduces the resistance to the recording paper, enabling the recording paper to be conveyed more smoothly. Further, sloped surfaces are formed on the corner 122 and corner 123 of the ribs 121 through a process of beveling the corner 122 and corner 123. Hence, when the edge of the recording paper passing over the first fixed ribs 102 contacts the corners 122 of the ribs 121, the edge of the recording paper is guided smoothly onto the movable support piece 88. Hence, the movable support piece 88 does not interfere with the smooth conveyance of the recording paper. As described above, the bevel process is also performed on the corners of the first fixed ribs 102 and second fixed ribs 103, forming sloped surfaces in these areas. Hence, when the edge of a sheet of recording paper contacts the corners of the first fixed ribs 102 and second fixed ribs 103, the sloped surfaces facilitate the smooth conveyance of the recording paper.

As shown in FIG. 16, the lever member 126 engaged with the rotating plate 125 converts the rotation of the rotating plate 125 into displacement of the movable support piece 88 in the conveying direction by a prescribed ratio. Accordingly, the movable support piece 88 can slide in synchronization with the conveyance of the recording paper. At the same time, the rotational amount of the rotating plate 125 is amplified as displacement in the conveying direction, making it possible to reduce the size of the rotating plate 125 and design a more compact multifunction device 1.

In the preferred embodiment, the locking member 139 is normally engaged with the rotating plate 125, as shown in FIG. 12. Therefore, unless borderless recording is performed, the movable support piece 88 does not slide along with the recording paper. At this time, the movable support piece 88 is disposed between the first fixed ribs 102 and second fixed ribs 103 and helps prevent the recording paper conveyed over the platen 42 from entering the groove 116. The locking member 139 may also be separated from the rotating plate 125 when performing borderless recording. Hence, the setting for borderless recording or border recording may be freely modified by moving the locking member 139.

Next, a variation of the preferred embodiment will be described.

Figure 17:
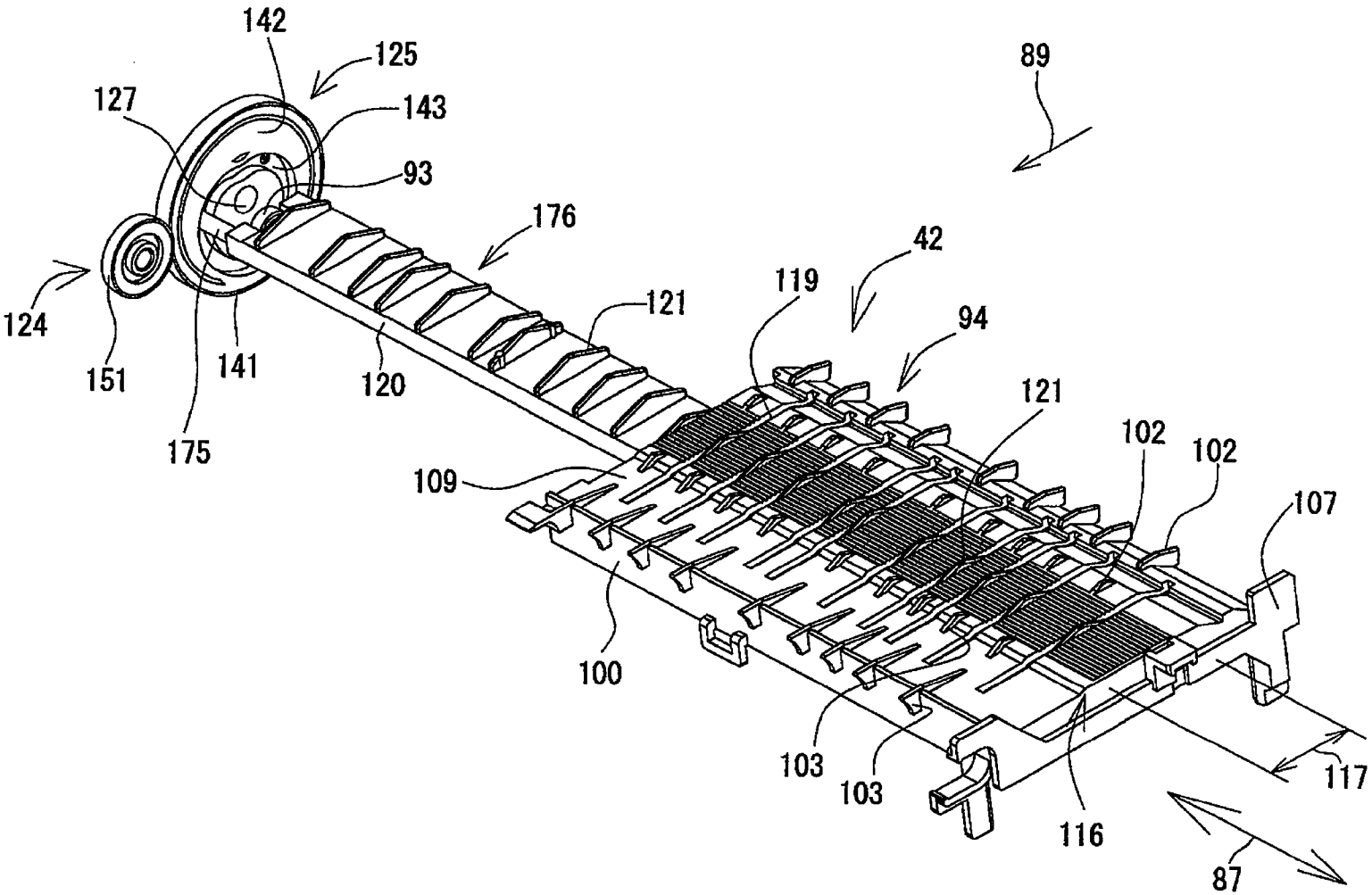
FIG. 17 is an enlarged perspective view of a multifunction device according to a variation of the first embodiment.

FIG. 17 is an enlarged perspective view of the platen 42 and movable support piece 176 in the multifunction device 1 according to a variation of the preferred embodiment.

In the preferred embodiment described above, the movable support piece 88 is provided with the lever member 126, as shown in FIG. 11, for coupling the movable support piece 88 to the rotating plate 125. However, the movable support piece 176 of the variation is provided with an engaging pin 175 that is fitted into the guide groove 143 of the rotating plate 125. For this reason, the cylindrical shaft 127 of the rotating plate 125 extends along the main scanning direction, indicated by the arrow 87, requiring a modification in the geometry of the drive transmitting mechanism 124 that includes the gear 151 for driving the rotating plate 125. The remaining structure of the movable support piece 176 is identical to the movable support piece 88 in the preferred embodiment.

More specifically, an engaging surface 142 ("back surface" in the preferred embodiment) of the rotating plate 125 is substantially orthogonal to the top surface 109 of the platen 42. The engaging pin 175 protrudes from an end surface of the movable support piece 176 and fits into the guide groove 143 formed in the engaging surface 142 of the rotating plate 125. The engaging pin 175 is capable of sliding within the guide groove 143. Hence, rotation of the rotating plate 125 slides the movable support piece 176 via the engaging pin 175 in the variation of the embodiment so that the ribs 121 can reliably support recording paper conveyed over the platen 42. Moreover, since the movable support piece 176 is slid via the engaging pin 175, the interlock mechanism 105 functioning to drive the movable support piece 176 can be achieved with a simple structure.

Second Embodiment

Next, a second embodiment of the present invention will be described.

Figure 18:
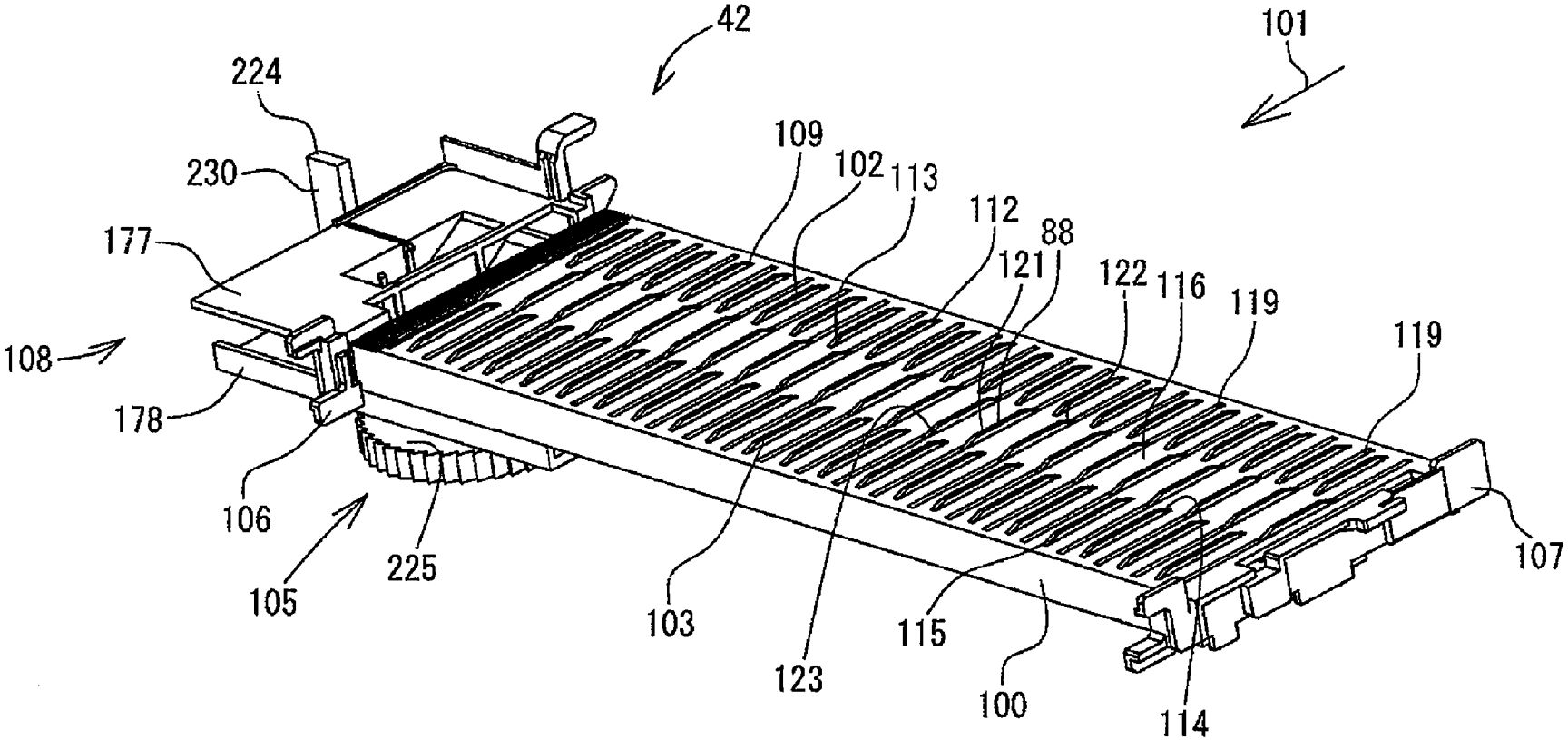
FIG. 18 is an enlarged perspective view of a platen in a multifunction device according to a second embodiment.
Figure 19:
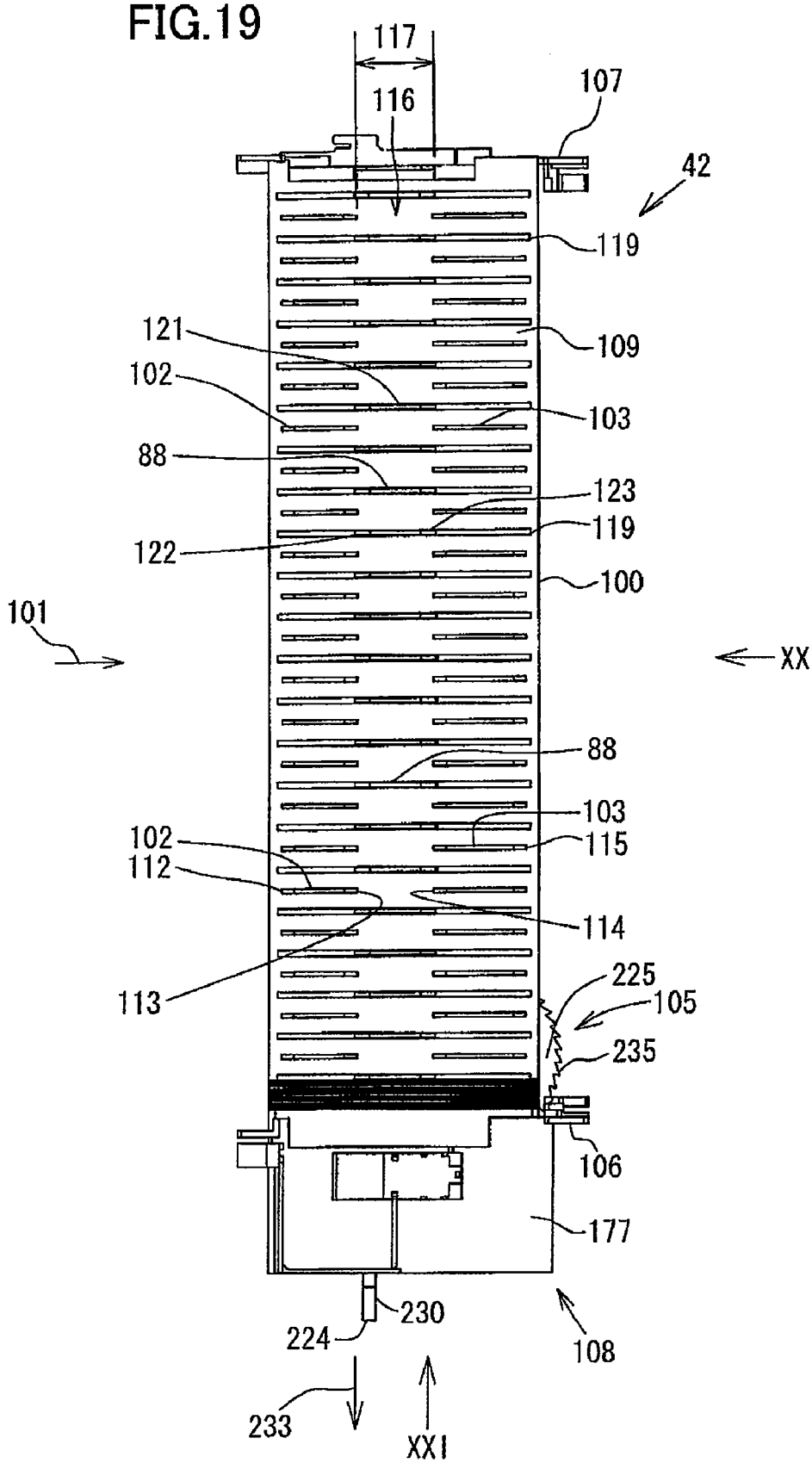
FIG. 19 is a front view of the platen in the multifunction device of the second embodiment.
Figure 20:
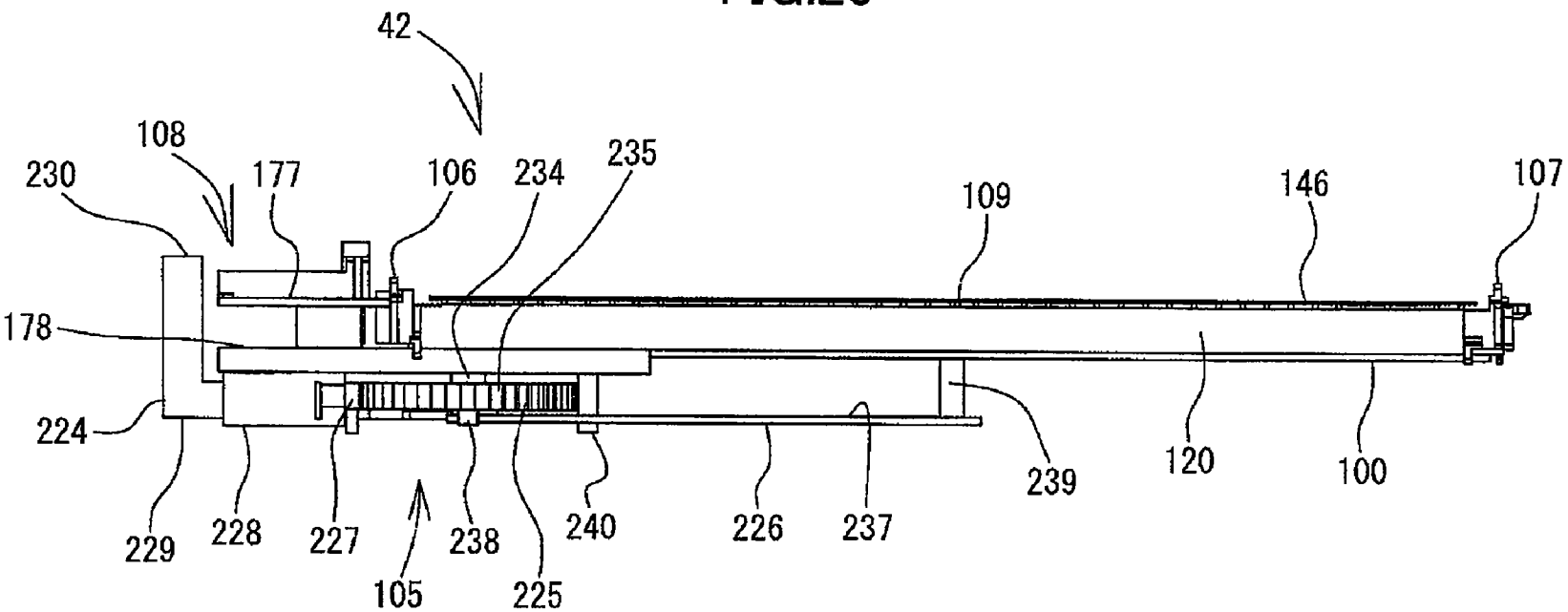
FIG. 20 is a view of the platen indicated by an arrow XX in FIG. 19.
Figure 21:
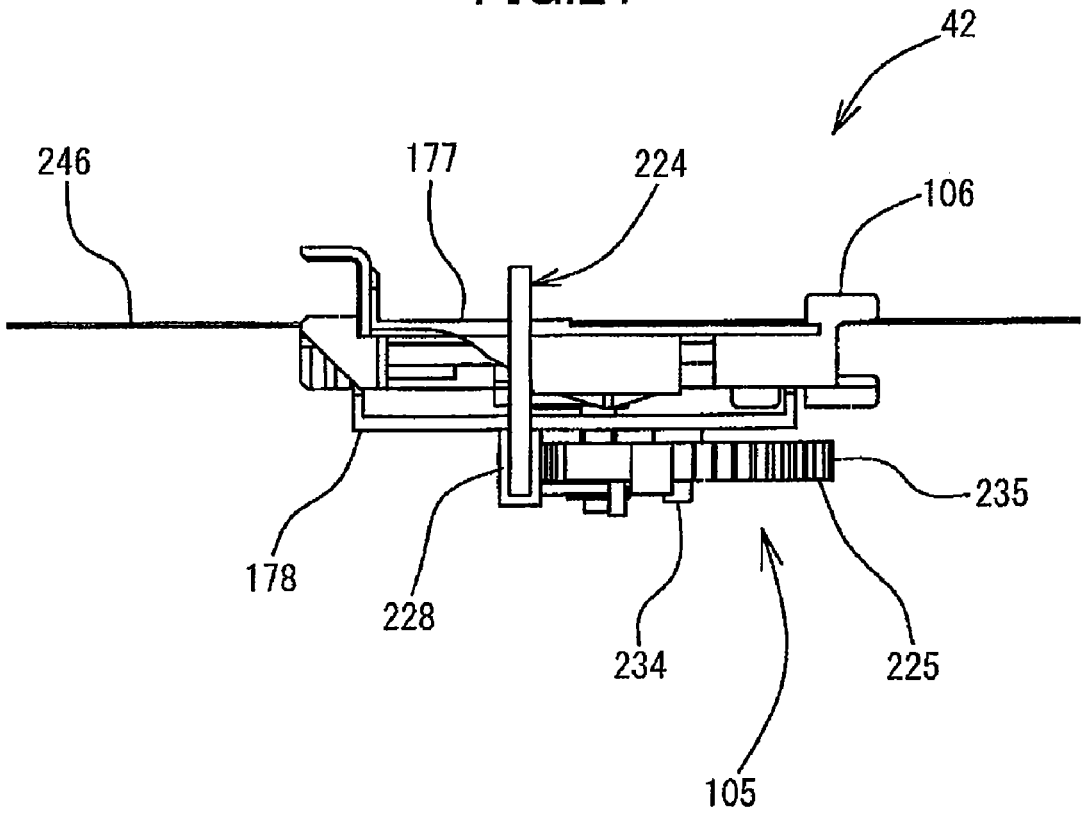
FIG. 21 is a view of the platen indicated by an arrow XXI in FIG. 19.
Figure 22:
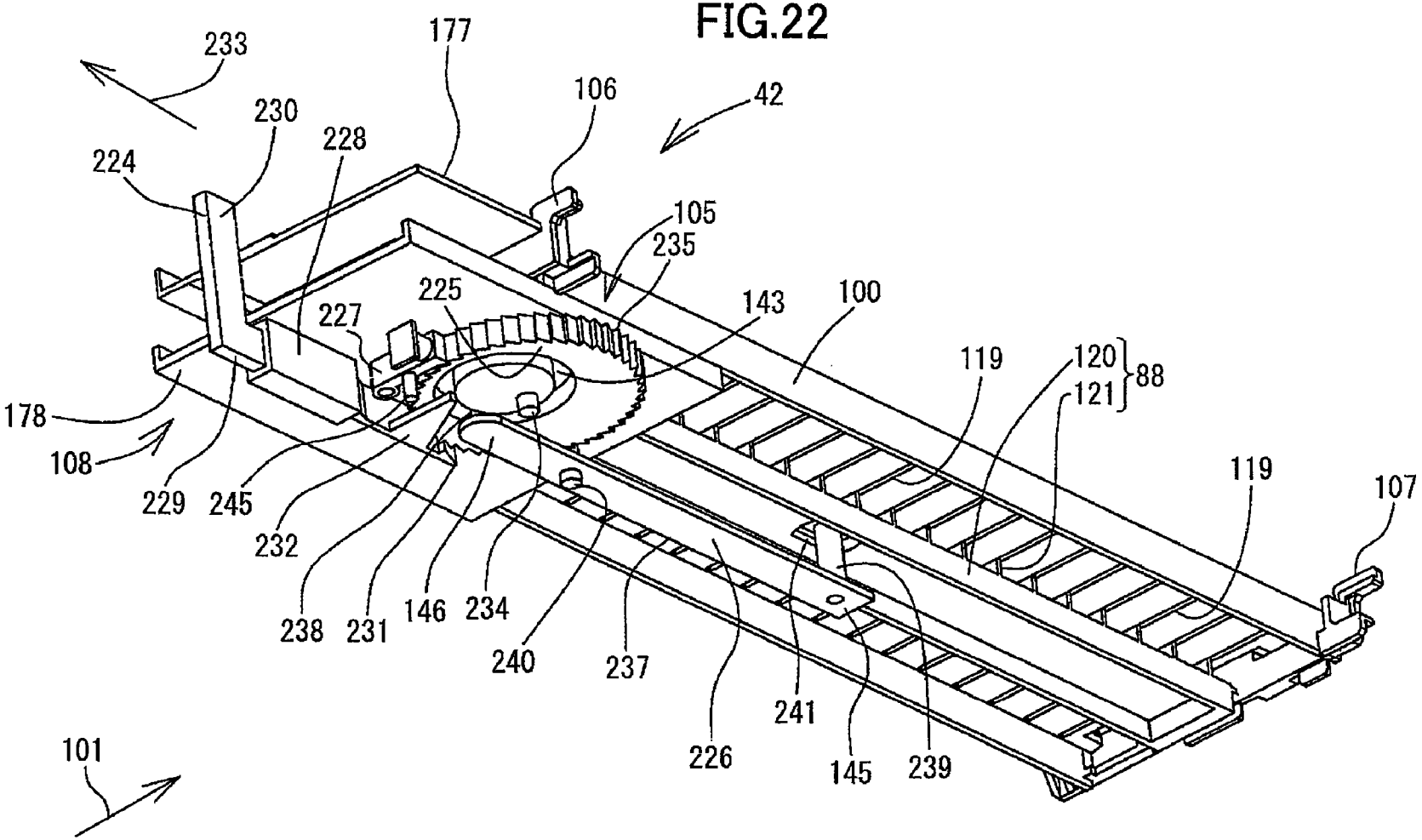
FIG. 22 is a bottom view of the platen in the multifunction device of the second embodiment.
Figure 23:
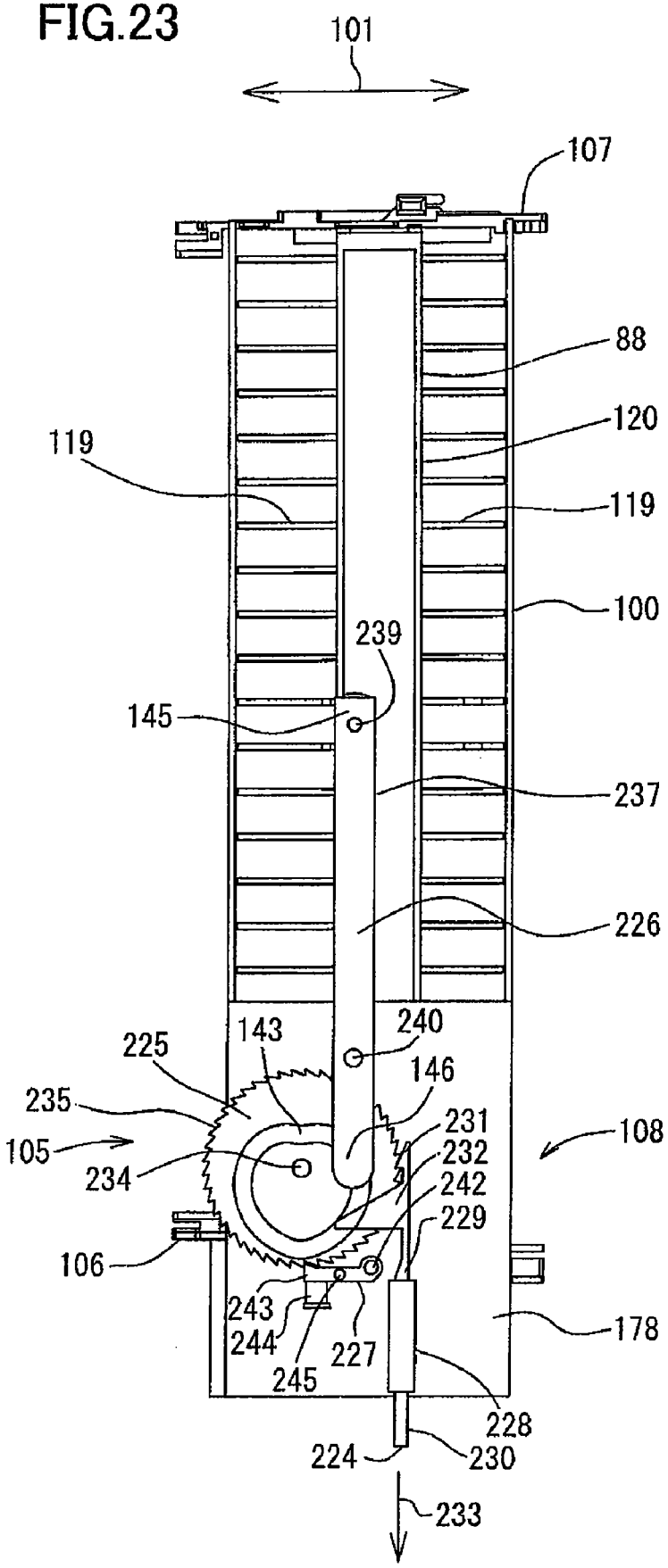
FIG. 23 is a bottom view of the platen in the multifunction device of the second embodiment.

FIG. 18 is an enlarged perspective view of the platen 42 in the multifunction device 1 according to a second embodiment of the present invention. FIG. 19 is a front view of the platen 42. FIGS. 20 and 21 are views of the platen 42 indicated by the arrows XX and XXI, respectively, in FIG. 19. FIG. 22 is a perspective view from the bottom surface of the platen 42. FIG. 23 is a bottom view of the platen 42. Next, the structures of the platen 42, movable support piece 88, and interlock mechanism 105 according to the second embodiment will be described in detail. Except for these components, the structure of the multifunction device 1 in the following description is identical to that in the first embodiment.

As in the first embodiment described above, the platen 42 in the second embodiment is disposed opposite the inkjet recording head 39 (below the inkjet recording head 39 in FIG. 3) for supporting recording paper during a recording operation (see FIGS. 3 and 5). As shown in FIG. 18, the platen 42 has an overall rectangular plate shape that is thin and narrow, with the longitudinal dimension of the platen 42 extending in the main scanning direction. The arrow 101 in FIG. 18 indicates the paper-conveying direction.

The platen 42 includes the frame 100; the first fixed ribs 102 and second fixed ribs 103 disposed on the frame 100; the movable support piece 88 slidably provided on the frame 100; and the interlock mechanism 105 for sliding the movable support piece 88.

The frame 100 is formed of a synthetic resin or steel plate, for example, and constitutes the frame of the platen 42. The cross-section of the frame 100 is shaped similar to the letter C. The bracket 106 and bracket 107 are disposed one on the base end and distal end of the frame 100. The bracket 106 and bracket 107 are integrally formed with the frame 100. The frame 100 is fixed to the multifunction device 1 via the bracket 106 and bracket 107.

The drive mechanism mounting section 108 is disposed on the base end of the frame 100. As shown in FIGS. 18 and 22, the drive mechanism mounting section 108 includes an upper plate 177 extending from the top surface 109 side of the frame 100, and a lower plate 178 provided on the lower surface side of the frame 100. The upper plate 177 and lower plate 178 are both rectangular in shape and are formed integrally with the frame 100. The lower plate 178 supports the interlock mechanism 105 described later in greater detail.

The first fixed ribs 102 and second fixed ribs 103 are provided on the top surface 109 of the frame 100. More specifically, the first fixed ribs 102 are provided on an upstream end of the top surface 109 in the paper-conveying direction and protrude upward toward the inkjet recording head 39. Similarly, the second fixed ribs 103 are provided on the downstream side of the top surface 109 and protrude upward. As shown in FIG. 18, the first fixed ribs 102 and second fixed ribs 103 in the preferred embodiment are thin, rectangular plate-shaped members erected from the top surface 109.

In the preferred embodiment, the first fixed ribs 102 are provided on the top surface 109 and juxtaposed in the main scanning direction. Similarly, the second fixed ribs 103 are provided on the top surface 109 and juxtaposed in the main scanning direction. With this construction, the groove 116 is formed between the first fixed ribs 102 and second fixed ribs 103. As shown in FIGS. 18 and 19, the groove 116 extends in the main scanning direction and expands in the paper-conveying direction. The groove 116 has a width dimension 117 that corresponds to the size of the inkjet recording head 39. Specifically, the width dimension 117 of the groove 116 is set wider than the ink ejection range 118 (see FIG. 6) of the inkjet recording head 39.

As shown in FIG. 19, each of the first fixed ribs 102 opposes one of the second fixed ribs 103 across the groove 116 in the paper-conveying direction indicated by the arrow 101. As shown in FIG. 18, corners 112 and 113 of the first fixed rib 102 are beveled to form a pair of sloped surfaces. In the preferred embodiment, sloped surfaces are formed on both the 112 and 113 of the first fixed rib 102 in the paper-conveying direction. However, it is also possible to form a sloped surface in only the corner 112. Similarly, corners 114 and 115 of the second fixed ribs 103 are beveled to form a pair of sloped surfaces. In the preferred embodiment, sloped surfaces are formed on both the corners 114 and 115 of the second fixed rib 103 in the paper-conveying direction. However, it is also possible to form a sloped surface in only the corner 114 on the upstream side.

A plurality of slits 119 is formed on the top surface 109 of the frame 100. As shown in FIG. 18, the slits 119 extend from the upstream end to the downstream end of the top surface 109 in the paper-conveying direction. Each slit 119 extends from the region between neighboring first fixed ribs 102 to the region between neighboring second fixed ribs 103. The movable support piece 88 is fitted into the slit 119 from below and protrudes upward from the slits 119.

As shown in FIG. 22, the movable support piece 88 includes the base 120 formed in a box shape, and the ribs 121 configured of thin, rectangular plate-shaped members. The movable support piece 88 is configured of a synthetic resin or metal. The base 120 is configured of a member having a C-shaped cross-section that fits inside the frame 100. While not shown in FIG. 22, both ends of the base 120 in the main scanning direction are slidably supported by the frame 100. Hence, the base 120 can slide smoothly inside the frame 100 in the paper-conveying direction indicated by the arrow 101 in FIG. 23.

The ribs 121 are provided on the top surface of the base 120 and are formed integrally with the same. Each of the ribs 121 is formed in a rectangular shape and protrudes upward from the top surface 109 of the frame 100 through the slits 119, as shown in FIG. 18. A plurality of the ribs 121 are provided on the top surface of the base 120. As shown in FIG. 22, the ribs 121 are juxtaposed at prescribed intervals in the main scanning direction. The prescribed intervals correspond to the pitch of the slits 119. Hence, the ribs 121 pass through and protrude upward from the slits 119.

A beveling process similar to that performed on the first fixed ribs 102 and second fixed ribs 103 is performed on the corners 122 and 123 of the ribs 121, forming a pair of sloped surfaces on each rib 121. In the preferred embodiment, the sloped surfaces are formed on both of the corner 122 and corner 123 of each rib 121. However, it is possible to form the sloped surface on only the upstream corner 122.

As described above, the interlock mechanism 105 slides the movable support piece 88 in the paper-conveying direction. As shown in FIG. 22, the interlock mechanism 105 includes an input member 224, a rotating plate 225, and a pivoting member 226. In the preferred embodiment, the interlock mechanism 105 also includes a rotation-restricting member 227 for restricting rotation of the rotating plate 225, as will be described later, and a spring member (not shown). The spring member is configured of a spiral spring, for example, and is disposed between the upper plate 177 and lower plate 178. The spring member is fixed to either the upper plate 177 or the lower plate 178 and the rotating plate 225 and changes shape as the rotating plate 225 rotates. Hence, when the rotating plate 225 rotates as will be described later, the spring member stores strain energy corresponding to the rotational angle of the rotating plate 225. When this strain energy is released from the cylindrical shaft 127, the rotating plate 225 is rotated in the reverse direction.

The input member 224 is substantially L-shaped, as shown in FIG. 22, and includes a first arm 229 and a second arm 230. The input member 224 is disposed outside the printing region in the main scanning direction and is retained in this position by a holding part 228 disposed on the bottom surface of the lower plate 178. The holding part 228 is cylindrical with a rectangular cross-section. The first arm 229 of the input member 224 is slidably inserted into the holding part 228. As shown in FIGS. 22 and 23, an engaging pawl 231 is formed on an end of the first arm 229, while a restriction release arm 232 is formed on the base end side (the second arm 230 side) of the engaging pawl 231. The restriction release arm 232 releases the rotational restriction on the rotating plate 225, as will be described later. The second arm 230 is formed continuously from the base end of the first arm 229 and extends orthogonal to the first arm 229. In other words, as shown in FIG. 22, the second arm 230 extends a prescribed distance above the upper plate 177 of the drive mechanism mounting section 108. Hence, the carriage 38 supporting the inkjet recording head 39 presses against the second arm 230 when sliding in the direction of the arrow 233 (main scanning direction). Although not shown in FIG. 22, a spring is disposed inside the holding part 228 for elastically urging the input member 224 in the direction opposite the arrow 233. Therefore, if the carriage 38 separates from the input member 224 after pressing against the input member 224 in the direction of the arrow 233, the spring urges the input member 224 to slide in the direction opposite the arrow 233.

The rotating plate 225 is disc-shaped and capable of rotating on a rotational shaft 234. The rotational shaft 234 is fixed to the frame 100 (more specifically, the lower plate 178) and inserted through the center of the rotating plate 225. A plurality of teeth 235 is formed continuously around the periphery of the rotating plate 225. The teeth 235 engage with the engaging pawl 231 of the input member 224. Hence, when the input member 224 is slid in the direction of the arrow 233, as described above, the rotating plate 225 rotates clockwise in FIG. 23 about the rotational shaft 234. Further, since the input member 224 is elastically urged in a direction opposite the arrow 233, as described above, the input member 224 slides in the direction opposite the arrow 233 after the carriage 38 presses the input member 224 in the direction of the arrow 233 and subsequently separates therefrom. Hence, the engaging pawl 231 once again engages with the teeth 235. Further, as shown in FIGS. 22 and 23, the guide groove 143 is formed in the rotating plate 225. The guide groove 143 describes an Archimedean spiral, identical to the shape of the guide groove 143 formed in the rotating plate 125 of the first embodiment. A base end of the pivoting member 226 is engaged in the guide groove 143.

The pivoting member 226 includes a main body 237 configured of a long slender plate, an engaging pin 238 disposed on the base end 146 of the main body 237, and an engaging rod 239 disposed on the distal end 145 of the main body 237. The pivoting member 226 is configured of a synthetic resin or metal. The main body 237 is rotatably supported on a pivot shaft 240. The pivot shaft 240 is fixed to the lower plate 178 of the drive mechanism mounting section 108 and inserted through a center portion of the main body 237. The engaging pin 238 protrudes upward from the main body 237 (see FIG. 22) and fits into the guide groove 143 of the rotating plate 225. The outer diameter of the engaging pin 238 corresponds to the width of the guide groove 143 so that the engaging pin 238 can slide relative to the rotating plate 225 along the guide groove 143 without play. When the engaging pin 238 moves relative to the rotating plate 225 along the guide groove 143, the main body 237 rotates about the pivot shaft 240. Hence, the pivoting member 226 pivots around the pivot shaft 240 so that the engaging rod 239 disposed on the distal end 145 of the main body 237 slides in an arc about the pivot shaft 240 The engaging rod 239 is coupled to the base 120 of the movable support piece 88. An elongated hole 241 extending in the longitudinal direction (main scanning direction) is formed in the base 120. The engaging rod 239 is fitted into the elongated hole 241. The outer diameter of the engaging rod 239 corresponds to the inner diameter of the elongated hole 241 so there is no play between the base 120 and elongated hole 241 other than in the main scanning direction.

Therefore, when the main body 237 pivots as described above so that the engaging rod 239 moves in an arc about the pivot shaft 240, the base 120 slides in the conveying direction as the engaging rod 239 slides along the elongated hole 241 in the main scanning direction. As described above, both ends of the base 120 in the main scanning direction are slidably supported on the frame 100. Accordingly, the base 120 slides smoothly in the paper-conveying direction (indicated the arrow 101 in FIG. 23) along a plane in the frame 100 parallel to the top surface 109. Hence, the pivoting member 226 slides the movable support piece 88 in the paper-conveying direction.

The rotation-restricting member 227 employs an engaging rod for engaging with the rotating plate 225. As shown in FIG. 23, the rotation-restricting member 227 is rotatably supported by a support pin 242. The support pin 242 is erected from the lower plate 178 of the drive mechanism mounting section 108 and inserted into the base end of the rotation-restricting member 227. An engaging pawl 243 is formed on the distal end of the rotation-restricting member 227 and engages with the teeth 235 on the rotating plate 225. Consequently, the rotating plate 225 is allowed to rotate clockwise in FIG. 23, but restricted from rotating counterclockwise. A spring 244 elastically urges the rotation-restricting member 227 toward the rotating plate 225. Therefore, the rotation-restricting member 227 is engaged with the rotating plate 225 at all times for restricting rotation of the same.

The rotation-restricting member 227 is also provided with a contact pin 245. The contact pin 245 protrudes downward from the rotation-restricting member 227 (see FIG. 22). As described above, the input member 224 is slid in the direction of the arrow 233. However, when the input member 224 is slid to a prescribed restriction release position, the restriction release arm 232 contacts the contact pin 245 and presses the 245 in the direction of the arrow 233. The pressure on the contact pin 245 rotates the rotation-restricting member 227 against the elastic force of the spring 244, disengaging the engaging pawl 243 from the rotating plate 225 and releasing the rotational restriction on the rotating plate 225.

In the preferred embodiment, the engaging pin 238 is engaged with the guide groove 143 at a prescribed position in FIG. 23 (initial position). At this time, the movable support piece 88 is positioned in the center of the frame 100 between the first fixed ribs 102 and second fixed ribs 103, as shown in FIG. 18. As described in the first embodiment, the movable support piece 88 is normally disposed in this position.

When the inkjet recording head 39 reciprocates in the main scanning direction, the carriage 38 intermittently presses against the input member 224, causing the rotating plate 125 to rotate clockwise in FIG. 23 intermittently at prescribed angles of rotation (corresponding to the rotational feed amount of the teeth 235). When the rotating plate 225 rotates in this way, the guide groove 143 pivots about the rotational shaft 234 and, hence, the engaging pin 238 engaged in the guide groove 143 moves toward the left along with the rotation of the rotating plate 225. When the rotational angle of the rotating plate 225 reaches 90°, the engaging pin 238 begins to move toward the right along with the rotation of the rotating plate 225 and continues moving right until the rotational angle of the rotating plate 225 reaches 270°.

FIGS. 24 and 25 are explanatory diagrams showing the relationship between the conveyance of the recording paper and the movement of the movable support piece 88.

Figure 24A:
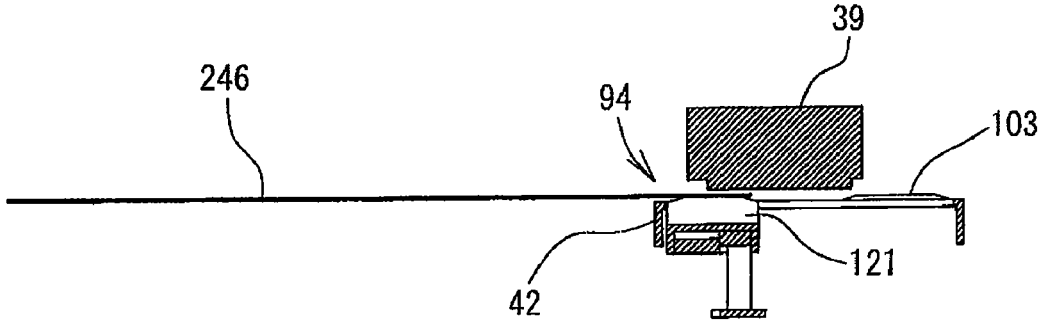
FIGS. 24A-C is an explanatory diagram showing the relationship between the movable support piece and the recording paper according to the second embodiment.

The movable support piece 88 is initially positioned between the first fixed ribs 102 and second fixed ribs 103. However, when a sheet of recording paper 246 is conveyed to the upstream edge 94 of the frame 100, as shown in FIG. 24A, the movable support piece 88 moves upstream in the paper-conveying direction to meet the recording paper 246. Specifically, when a sheet of the recording paper 246 fed along the paper-conveying path 23 (see FIG. 3) reaches the conveying roller 60, the conveying roller 60 conveys the sheet over the platen 42.

As described in the first embodiment, to perform an image-recording operation the controller 64 drives the linefeed motor 71 in order to rotate the feeding roller 25. The feeding roller 25 feeds a sheet of recording paper stacked in the feeding tray 20 onto the paper-conveying path 23. When feeding a sheet of recording paper, the linefeed motor 71 is driven in a reverse rotation. The drive force of the linefeed motor 71 is transferred to the feeding roller 25 and rotates the feeding roller 25 in a direction for feeding the recording paper. The driving force is also transferred to the conveying roller 60 and discharge rollers 62 for rotating the conveying roller 60 and discharge rollers 62 in the direction opposite the paper-conveying direction. Recording paper conveyed from the feeding tray 20 along the paper-conveying path 23 is guided by the paper-conveying path 23 along a U-shaped path that curves upward and back in the opposite direction. As the recording paper is conveyed farther, the leading edge of the paper first contacts the registration sensor 95 and subsequently contacts the conveying roller 60 and the pinch roller. Since the conveying roller 60 is rotating in a direction opposite the paper-conveying direction, the recording paper is registered by contacting the conveying roller 60 and the pinch roller. The registration position is indicated by the reference numeral 174 in FIG. 15. After recording paper has been registered, the controller 64 begins driving the linefeed motor 71 to rotate forward. Consequently, the registered recording paper is pinched between the conveying roller 60 and the pinch roller and conveyed over the platen 42 as indicated by the line 167 in FIG. 15.

When performing borderless recording, the movable support piece 88 is slid along with the conveyance of the recording paper. More specifically, when the recording paper is at the registration position 174, the movable support piece 88 is positioned in the center of the platen 42, as described above. At this time, the base end 146 of the pivoting member 226 is disposed in a prescribed position of the guide groove 143 (an initial position similar to the position indicated by the reference numeral 165 in FIG. 14), as shown in FIG. 23.

After the leading edge of the recording paper 246 has been registered on the conveying roller 60, the linefeed motor 71 is driven intermittently, as indicated by the line 168 in FIG. 15, conveying the recording paper 246 to a recording position on the platen 42. Subsequently, the carriage motor 73 is driven at a prescribed timing indicated by the line 169 in FIG. 15 for slidingly moving the carriage 38 in the main scanning direction until the carriage 38 contacts the input member 224. Here, the controller 64 controls the amount that the carriage 38 is slid by driving the carriage motor 73.

When the carriage 38 slides against the input member 224, the rotating plate 225 rotates clockwise in FIG. 23, moving the movable support piece 88 upstream in the paper-conveying direction, as shown in FIG. 24A. When the rotational angle of the rotating plate 225 reaches 90°, the movable support piece 88 has arrived at the first position for meeting the recording paper 246.

Figure 24B:
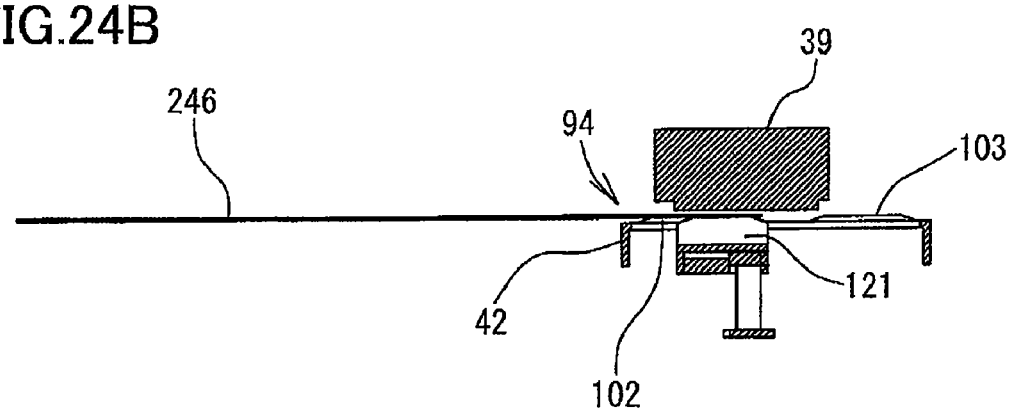
Figure 24C:
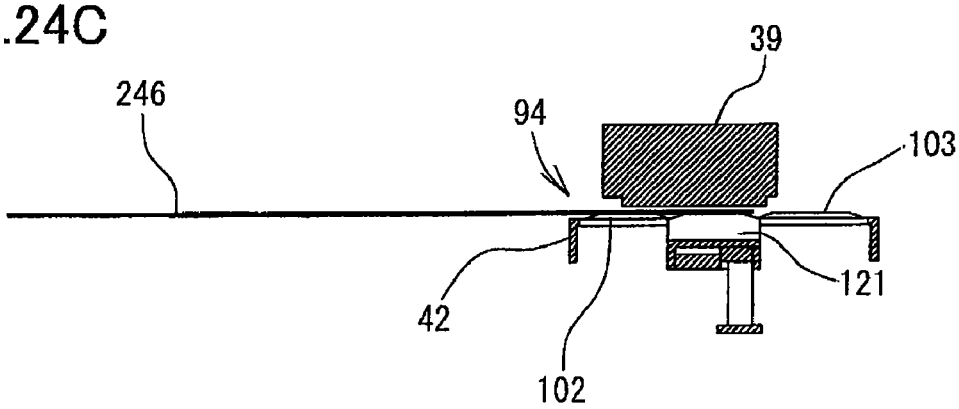

Thereafter, each time the carriage 38 slides into the input member 224 during the image-recording operation, the rotating plate 225 is rotated clockwise in FIG. 23. As the rotating plate 225 rotates progressively clockwise, the movable support piece 88 moves downstream in the paper-conveying direction along with the recording paper 246, while supporting the leading edge of the recording paper 246, as shown in FIG. 24B. When the rotational angle of the rotating plate 125 reaches 180°, the 121 have moved from the first position to the initial position (center of the groove 116), as shown in FIG. 24C.

Figure 25A:
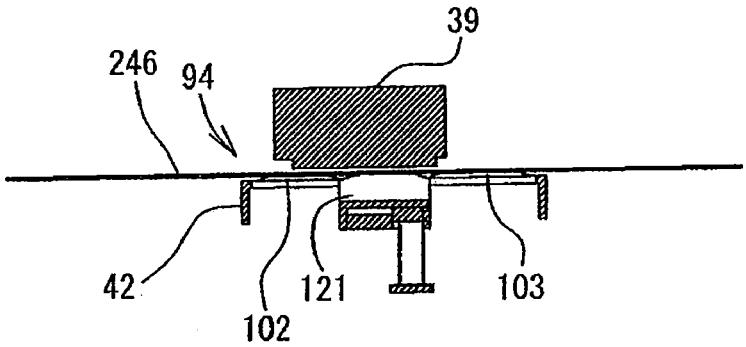
FIGS. 25A-C is an explanatory diagram showing the relationship between the movable support piece and the recording paper according to the second embodiment.

After the rotational angle of the rotating plate 125 has reached 180° and the movable support piece 88 has moved between the first fixed ribs 102 and second fixed ribs 103, the movable support piece 88 is maintained in this position while the recording paper 246 continues to be conveyed in the paper-conveying direction and the image-recording operation continues to be performed, as shown in FIG. 25A. In this way, the sliding distance of the inkjet recording head should be controlled so that the carriage 38 does not contact the input member 224 as a means for maintaining the movable support piece 88 while the recording paper 246 is conveyed.

Figure 25B:
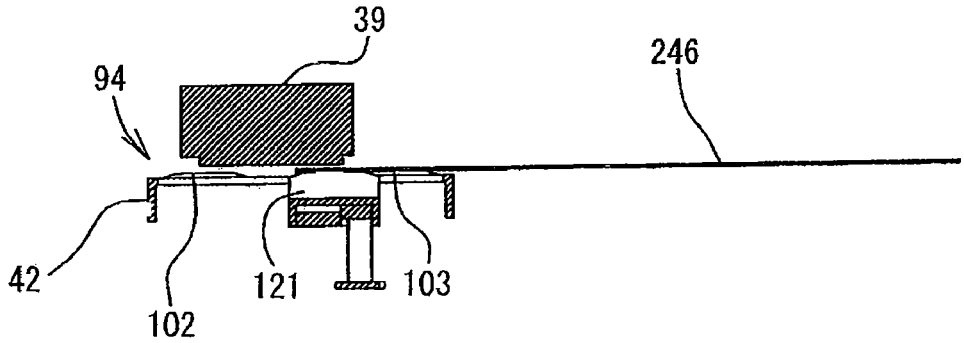
Figure 25C:
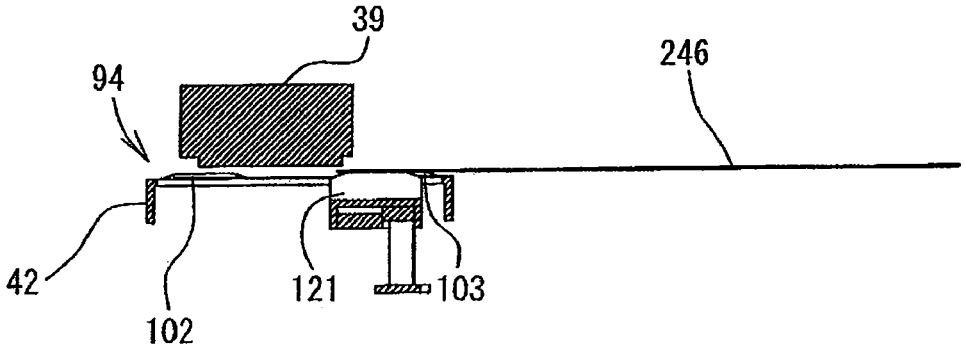

When the recording paper 246 has been conveyed far enough for the trailing edge to reach the movable support piece 88, as shown in FIG. 25B, the movable support piece 88 is again slid in the paper-conveying direction so as to move downstream along with the recording paper 246 while supporting the trailing edge of the recording paper 246, as shown in FIG. 25C. More specifically, the carriage 38 is again slid against the input member 224, causing the rotating plate 225 to rotate clockwise in FIG. 23 and, hence, moving the movable support piece 88 further downstream in the paper-conveying direction. When the rotational angle of the rotating plate 225 reaches 270°, the movable support piece 88 has arrived at the second position. Subsequently, the sliding distance of the inkjet recording head 39 should be controlled so that the carriage 38 again contacts the input member 224 as a means for resuming movement of the movable support piece 88 halted between the first fixed ribs 102 and second fixed ribs 103 (initial position).

When the recording paper 246 is discharged, the carriage 38 slides the input member 224 to a prescribed restriction release position. Here, the carriage motor is driven to slide the carriage 38 to a prescribed position for moving the input member 224 to the restriction release position. More specifically, the input member 224 is slid in the direction of the arrow 233 shown in FIG. 23 until the restriction release arm 232 presses against the support pin 242 This pressure causes the rotation-restricting member 227 to rotate counterclockwise against the elastic force of the spring 244, releasing the rotational restriction on the rotating plate 225. Since strain energy is stored in the spring member when the rotating plate 225 rotates, this strain energy is released when the rotational restriction on the rotating plate 225 is released, causing the rotating plate 225 to rotate in reverse (counterclockwise in FIG. 23). When all of the strain energy is released, the rotating plate 225 rotates counterclockwise 270°, thereby returning the movable support piece 88 to the initial position.

In the multifunction device 1 of the preferred embodiment, the platen 42 supports the recording paper 246 as the recording paper 246 is conveyed over the top thereof, and an image is recorded on the recording paper 246 supported on the platen 42 with ink droplets ejected from the inkjet recording head 39 as the inkjet recording head 39 reciprocates. As the recording paper 246 is conveyed in the paper-conveying direction during the image-recording operation, the movable support piece 88 slides together with the recording paper 246 in the same direction while supporting the recording paper 246, as shown in FIGS. 24 and 25. Therefore, the movable support piece 88 constantly supports the edge of the recording paper 246 during the image-recording operation, preventing the edge from bending in the paper-conveying direction. Accordingly, the recording paper 246 does not droop down into the groove 116 formed between the first fixed ribs 102 and second fixed ribs 103 in the preferred embodiment (see FIGS. 18 and 19), and a fixed distance is maintained between the recording paper 246 and the inkjet recording head 39. As a result, the multifunction device 1 can perform high-quality printing, as in the first embodiment.

More specifically, the recording paper 246 is conveyed over the platen 42 while first supported by the first fixed ribs 102 and subsequently supported by the second fixed ribs 103 after passing over the groove 116. During borderless recording, the groove 116 can receive ink droplets ejected from the inkjet recording head 39 beyond the edges of the recording paper 246, thereby preventing such ink droplets from becoming deposited on the underside of subsequent sheets of the recording paper 246. As the recording paper 246 is conveyed over the groove 116, the movable support piece 88 slides in the paper-conveying direction along with the conveyance of the recording paper 246. In other words, the movable support piece 88 supports the recording paper 246 while sliding from the first position to the second position. Hence, the movable support piece 88 reliably supports the edges of the recording paper 246 at all times, preventing the recording paper 246 from entering the groove 116. As a result, the movable support piece 88 maintains a fixed distance between the recording paper 246 and the inkjet recording head 39, as described above, thereby achieving high-quality printing.

As shown in FIG. 22, the movable support piece 88 is driven by the rotation of the rotating plate 225 while the rotating plate 225 rotates about the rotational shaft 234. Hence, the rotating plate 225 in the preferred embodiment rotates within a plane parallel to the top surface 109 of the platen 42. Hence, the rotating plate 225 is disposed efficiently and compactly near the platen 42, making it possible to reduce the size of the image-recording unit 24 and design a more compact multifunction device 1.

In the preferred embodiment, the rotation-restricting member 227 functions to restrict rotation of the rotating plate 225. As shown in FIGS. 22 and 23, the input member 224 and rotation-restricting member 227 configure a ratchet structure that allows only clockwise rotation of the rotating plate 225 in FIG. 23. Accordingly, the rotating plate 225 rotates clockwise each time the inkjet recording head 39 reciprocates, enabling the movable support piece 88 to slide reliably in the paper-conveying direction for supporting the recording paper 246. Here, the controller 64 may control movement of the inkjet recording head 39 so that the carriage 38 presses against the input member 224 each time the inkjet recording head 39 reciprocates, or may adjust the rotation of the rotating plate 225 by having the carriage 38 press against the input member 224 every prescribed number of times the inkjet recording head 39 reciprocates. Controlling movement of the inkjet recording head 39 in this way, the controller 64 can synchronize the distance that the movable support piece 88 slides with the linefeed width of the recording paper 246.

By forming the guide groove 143 having the shape described above in the rotating plate 225 and rotating the rotating plate 225, the movable support piece 88 initially slides in the paper-conveying direction to meet the recording paper 246 and subsequently slides downstream together with the recording paper 246, as illustrated in FIGS. 24 and 25. With this method, the movable support piece constantly supports the edge of the recording paper 246, thereby reliably maintaining a fixed distance between the recording paper 246 and the inkjet recording head 39. Hence, images of a higher quality can be recorded on the recording paper 246.

By forming the guide groove 143 in the shape of an Archimedean spiral in the preferred embodiment, the movable support piece 88 smoothly follows the conveyed recording paper 246 at a fixed speed as the rotating plate 225 rotates at a fixed speed. If the intermittent rotation of the rotating plate 225 corresponds to the linefeed width of the recording paper 246, the movable support piece 88 slides in synchronization with the conveyance of the recording paper 246, providing more reliable support for the recording paper 246. Accordingly, the movable support piece 88 can more accurately maintain a fixed distance between the inkjet recording head 39 and the recording paper 246.

In the preferred embodiment, a spring member is disposed between the upper plate 177 and lower plate 178. The spring member deforms as the rotating plate 225 rotates and stores a strain energy corresponding to the rotational angle of the rotating plate 225. After the recording paper 246 is discharged, the controller 64 controls the sliding movement of the inkjet recording head 39 so that the carriage 38 presses the input member 224 into the restriction release position, releasing the rotational restriction on the rotating plate 225. Consequently, the strain energy stored in the spring member is released, causing the rotating plate 225 to rotate counterclockwise until the movable support piece 88 returns to the initial position shown in FIG. 18. Therefore, the movable support piece 88 returns to the initial position after the recording paper 246 is discharged, eliminating the need to initialize the movable support piece 88 for each sheet of recording paper 246. Accordingly, the multifunction device 1 of the preferred embodiment can perform continuous recording on a plurality of sheets of recording paper 246 at a high speed.

As shown in FIGS. 22 and 23, since the guide groove 143 formed like an Archimedean spiral is also circular in shape in the preferred embodiment, the movable support piece 88 slides in one continuous motion, initially sliding from the initial position upstream in the paper-conveying direction to meet the recording paper 246, then continuing downstream as the recording paper 246 is conveyed while supporting an edge of the recording paper 246, and finally continuing back upstream to the initial position. Therefore, even if the spring member were omitted, the movable support piece 88 would always reliably be returned to the initial position, eliminating the need to initialize the movable support piece 88 for each sheet of the recording paper 246. Accordingly, the multifunction device 1 of the preferred embodiment can perform continuous recording on a plurality of sheets of the recording paper 246 at a high speed.

By supporting the recording paper 246 with the movable support piece 88 in the preferred embodiment, the groove 116 may be formed with a large width dimension 117. Therefore, even if the size of the inkjet recording head 39 were increased, the groove 116 can cover the entire ink ejection range 118 of the inkjet recording head 39. As a result, borderless recording can be executed at a higher speed. It is particularly advantageous to configure the parts supporting the recording paper 246 with ribs since the structure is extremely simple. Further, the area of contact between the recording paper 246 and the first fixed ribs 102, second fixed ribs 103, and movable support piece 88 (ribs 121) is reduced, facilitating the smooth conveyance of the recording paper 246.

As in the first embodiment, the groove 116 according to the second embodiment has a wider width dimension 117 than the ink ejection range 118 of the inkjet recording head 39. Hence, even if ink droplets were ejected from all nozzles 53 in the inkjet recording head 39 when the recording paper 246 is not present over the platen 42, the groove 116 can receive all of the ink droplets. Therefore, when performing borderless recording, ink droplets can be ejected from all the nozzles 53 in the inkjet recording head 39 when recording on the edges of the recording paper 246. Hence, borderless recording can be performed at a high speed, since there is no need to perform a complex control process to control ink droplet ejection. Further, the cross-sectional shape of the nozzles 53 is not always perfectly round and occasionally fine foreign matter may become deposited inside the nozzles 53, causing the ink droplets to be ejected along a slightly slanted trajectory from the nozzles 53. However, the ink droplets do not impact the platen 42 outside the groove 116 since the width dimension 117 of the groove 116 is wider than the ink ejection range 118 of the inkjet recording head 39, thereby reliably preventing ink from staining the underside surface of the recording paper 246.

Further, sloped surfaces are formed on the ribs 121 by beveling the corners 122 and 123 thereof (see FIG. 18). Consequently, the leading edge of the recording paper 246 is smoothly guided onto the top surface of the movable support piece 88 when contacting the corner 122 of the movable support piece 88. Hence, the movable support piece 88 can be provided without interfering with the smooth conveyance of the recording paper 246. Similarly, sloped surfaces are formed on the first and second fixed ribs 102 and 103 by beveling the corners 112-115 thereof. Accordingly, the fixed ribs 102 and 103 do not interfere with the smooth conveyance of the recording paper 246 when the recording paper 246 contacts the corners 112-115.

In particular, the carriage motor 73 drives the carriage 38 to slide in a reciprocating motion so as to contact and slide the input member 224 (see FIGS. 22 and 23). The rotating plate 225 rotates each time the input member 224 slides, while the pivoting member 226 converts the rotation of the rotating plate 225 into sliding displacement of the movable support piece 88. Therefore, the interlock mechanism 105 does not interfere with the operation for reliably conveying the recording paper 246, since the linefeed motor 71 is not directly the drive source of the movable support piece 88. While the carriage motor 73 functions as the drive source of the movable support piece 88 in the preferred embodiment, the carriage motor 73 controls the carriage 38 to press against the input member 224 in a region outside the scanning range of the carriage 38 (that is, an area outside the image-recording range), thereby ensuring that the recording paper 246 is conveyed accurately within the image-recording range.

The movement of the movable support piece 88 described above is particularly necessary when performing borderless recording on the recording paper 246 and is not necessary when performing border recording. Since the movable support piece 88 is normally idle in the position shown in FIG. 18, it is possible to fix the movable support piece 88 in the position shown in FIG. 18 and to not drive the movable support piece 88 when performing border recording. In this case, the controller 64 may adjust the distance that the inkjet recording head 39 moves as a means for fixing the movable support piece 88. In other words, the controller 64 may drive the carriage motor 73 so that the carriage 38 does not contact the input member 224.

What is claimed is:

1. An inkjet-recording device comprising:

a recording head configured to eject ink droplets onto a recording medium;

a platen disposed in confrontation with the recording head to support the recording medium while keeping a predetermined distance from the recording head;

a conveying member configured to convey the recording medium in a conveying direction; and a movable supporting member linked to the conveying member to slide in the conveying direction while supporting the recording medium, the movable supporting member is mechanically linked to the conveying member.

2. The inkjet-recording device according to claim 1, wherein the movable supporting member follows the recording medium in supporting the recording medium.

3. The inkjet-recording device according to claim 1, wherein the conveying member comprises a discharge roller having a first rotational shaft and rotatable about the first rotational shaft to discharge the recording medium.

4. The inkjet-recording device according to claim 3, wherein the platen comprises:

a top surface opposing the recording head and extending along the conveying direction, and having a first part and a second part opposing the first part in the conveying direction;

a first protrusion protruding from the first part to support the recording medium; and a second protrusion protruding from the second part to support the recording medium, the recording medium being conveyed from the first part to the second part, a groove being formed between the first protrusion and the second protrusion, the movable supporting member being provided in the groove.

5. The inkjet-recording device according to claim 4, wherein the first protrusion comprises a plurality of first ribs arrayed in a first direction orthogonal to the conveying direction, wherein the second protrusion comprises a plurality of second ribs protruding arrayed in the first direction, the plurality of second ribs being provided in one-to-one correspondence with the plurality of first ribs, a combination of each first rib and each second rib confronting the first rib constructing a rib unit, wherein the movable supporting member comprises a plurality of movable ribs protruding to support the recording medium, the plurality of movable ribs being arrayed in the first direction and provided between adjacent rib units.

6. The inkjet-recording device according to claim 4, wherein the recording head has a plurality of nozzles through which ink droplets are ejectable over an ejection region onto the top surface of the platen, wherein the groove has a width wider than that of the ejection region in the conveying direction.

7. The inkjet-recording device according to claim 1, wherein the movable supporting member has a chamfered corner at a position where a leading end of the recording medium is abutable in the conveying direction.

8. An inkjet-recording device comprising:

a recording head configured to eject ink droplets onto a recording medium;

a platen disposed in confrontation with the recording head to support the recording medium while keeping a predetermined distance from the recording head;

a conveying member configured to convey the recording medium in a conveying direction;

a movable supporting member linked to the conveying member to slide in the conveying direction while supporting the recording medium; and a converting mechanism linking the first rotational shaft to the movable supporting member in order to convert a rotating motion of the discharge roller to sliding motion of the movable supporting member in the conveying direction, the conveying member comprises a discharge roller having a first rotational shaft and rotatable about the first rotational shaft to discharge the recording medium, wherein the platen comprises:

a top surface opposing the recording head and extending along the conveying direction, and having a first part and a second part opposing the first part in the conveying direction;

a first protrusion protruding from the first part to support the recording medium; and a second protrusion protruding from the second part to support the recording medium, the recording medium being conveyed from the first part to the second part, a groove being formed between the first protrusion and the second protrusion, the movable supporting member being provided in the groove.

9. The inkjet-recording device according to claim 8, wherein the converting mechanism provides a prescribed ration in converting the rotating motion to the sliding motion.

10. The inkjet-recording device according to claim 8, wherein the converting mechanism comprises:

a rotating plate having a second rotational shaft, and linked to the conveying member to rotate about the second rotational shaft, a guide groove being formed on the rotating plate; and a converting member linked to the movable supporting member, and having an engaging portion engagable with the guide groove that guides the engaging portion in the conveying direction as the rotating plate rotates.

11. The inkjet-recording device according to claim 10, wherein the rotating plate is formed in a disc shape, the second rotational shaft penetrating a center of the rotating plate.

12. The inkjet-recording device according to claim 10, wherein the rotating plate is parallel to the top surface of the platen.

13. The inkjet-recording device according to claim 10, wherein the guide groove is formed so that the movable supporting member slides from the second part to the first part before the recording medium has reached a prescribed part, and slides from the first part to the second part after the recording medium has reached a prescribed part.

14. The inkjet-recording device according to claim 10, wherein the guide groove is formed in a looped shape so that the engaging portion performs a periodical movement.

15. The inkjet-recording device according to claim 10, wherein the guide groove is formed with an Archimedean spiral.

16. The inkjet-recording device according to claim 15, wherein the Archimedean spiral is formed with a line symmetry about a hypothetical reference axis parallel to the top surface of the plated and passing the second rotational shaft.

17. The inkjet-recording device according to claim 10, wherein the converting mechanism further comprises a rotation preventing member configured to prevent the rotating plate from rotating.

18. The inkjet-recording device according to claim 17, wherein the converting mechanism further comprising a torque limiter configured to keep the first rotational shaft from stopping rotating even if the rotation preventing member prevents the rotating plate from rotating.

19. The inkjet-recording device according to claim 17, wherein the rotating plate is formed with a locking part, wherein the rotation preventing member comprises:

a locking member engagable with the locking part; and a biasing member configured to provide the locking member with a biasing power to engage the locking part;

wherein the locking member is disposed at a position where the recording head presses the locking member when moving in a first direction orthogonal to the conveying direction so that a pressing power of the recording head prevents the locking member from engaging the locking part against the biasing power.

20. The inkjet-recording device according to claim 19, further comprising a resist sensor configured to detect that the recording medium has reached a predetermined position, wherein the recording head starts moving in the first direction when the resist sensor detects that the recording medium has reached the predetermined position.

21. The inkjet-recording device according to claim 1, wherein the movable supporting member slides with respect to the platen.

* * * * *